US006457416B1

(12) United States Patent
Micke et al.

(10) Patent No.: US 6,457,416 B1
(45) Date of Patent: Oct. 1, 2002

(54) METHOD AND APPARATUS FOR REMOVING OBSTRUCTIONS IN MINES

(75) Inventors: Brian P. Micke, Golden; Mihailo Gavrilovic, Denver, both of CO (US); Keith W. Wright, Dianella (AU)

(73) Assignee: RockTek Limited, Pinjarra (AU)

( * ) Notice: Subject to any disclaimer, the term of this patent is extended or adjusted under 35 U.S.C. 154(b) by 0 days.

(21) Appl. No.: 09/173,876

(22) Filed: Oct. 16, 1998

Related U.S. Application Data

(60) Provisional application No. 60/062,537, filed on Oct. 17, 1997, and provisional application No. 60/087,058, filed on May 28, 1998.

(51) Int. Cl.[7] ..... F42B 10/00

(52) U.S. Cl. ..... 102/473

(58) Field of Search ..... 89/1.8; 102/473, 102/499, 500, 514, 202.12, 247

(56) References Cited

U.S. PATENT DOCUMENTS

| | | | | | |
|---|---|---|---|---|---|
| 1,585,664 | A | | 5/1926 | Gilman | |
| 2,359,301 | A | | 10/1944 | Church et al. | 102/56 |
| 2,725,821 | A | | 12/1955 | Coleman | 102/22 |
| 3,695,715 | A | | 10/1972 | Godfrey | 299/13 |
| 3,721,471 | A | | 3/1973 | Bergmann et al. | 299/55 |
| 3,777,665 | A | | 12/1973 | Ziemba | 102/70.2 P |
| 3,788,230 | A | | 1/1974 | Losfeld | 102/74 |
| 3,963,275 | A | | 6/1976 | Godfrey et al. | 299/13 |
| 4,388,868 | A | | 6/1983 | Frostig | 102/473 |
| 4,406,430 | A | | 9/1983 | Krammer et al. | 244/3.13 |
| H913 | H | * | 5/1991 | Hershowitz | 102/307 |
| 5,031,538 | A | | 7/1991 | Dufrane et al. | 102/275.5 |
| 5,081,929 | A | | 1/1992 | Mertens | 102/273 |
| 5,345,853 | A | | 9/1994 | Crepin et al. | 89/1.818 |
| 5,359,935 | A | | 11/1994 | Willett | 102/307 |
| 5,365,913 | A | * | 11/1994 | Walton | 124/75 |
| 5,404,820 | A | | 4/1995 | Hendrix | 102/201 |
| 5,429,030 | A | | 7/1995 | Tidman | 89/7 |
| 5,429,053 | A | * | 7/1995 | Walker | 102/342 |
| 5,474,364 | A | * | 12/1995 | Ruzzi et al. | 299/13 |
| 5,611,605 | A | | 3/1997 | McCarthy | 299/13 |
| 5,731,538 | A | | 3/1998 | O'Brien et al. | 102/202.5 |

FOREIGN PATENT DOCUMENTS

| | | |
|---|---|---|
| CA | 2015773 | 4/1990 |
| DE | 31 49 346 | 6/1983 |
| DE | 3533753 | 9/1985 |
| DE | 4226129 A | 8/1992 |
| EP | 230 720 | 8/1987 |
| EP | 0 230 720 A2 | 8/1987 |
| EP | 0 363 079 A2 | 4/1990 |
| EP | 602632 A | 12/1992 |
| FR | 568.425 | 3/1924 |
| ZA | 94 3791 | 5/1994 |

OTHER PUBLICATIONS

Society of Explosives Engineers, Inc. "Permissible Blasting/ Underground Coal Mines," Chapter 26, Blaster's Handbook, 17th Ed.

(List continued on next page.)

*Primary Examiner*—Thomas Price
(74) *Attorney, Agent, or Firm*—Sheridan Ross P.C.; Douglas W. Swartz, Esq

(57) ABSTRACT

The present invention is directed to a system for fragmenting rock obstacles and obstructions in mines. The system uses a projectile having a flat or concave nose and a detonating device that has a safety pin to prevent a striker from prematurely igniting the primer during handling of the projectile. The primer is designed to initiate a detonator which detonates an explosive charge upon impact of the projectile with the target rock. The system can include transmitters and receivers and counters to provide remote operation of projectile launch, prearming, arming and/or detonation.

35 Claims, 17 Drawing Sheets

OTHER PUBLICATIONS

Lundquist, R.; "Underground Tests of the Ream Method of Rock Fragmentation for High–Speed Tunneling"; *RETC Proceedings;* vol. 1; 1974; pp. 825–840.

Louie, N.; "Quasi–Continuous Explosive Concepts for Hard Rock Excavation"; Shock Hydrodynamics Division Whittaker Corporation; Jun. 1973; Final Report.

Singh, M.; "Rock Breakage by Pellet Impact"; *IIT Research Institute;* Dec. 24, 1969; Final Report.

Watson et al.; "Demonstration of High Speed Gun and Penetrating Cone Fracture Technology"; Proposal to *Climax Molybdenum Company/Henderson Mine;* Oct. 1990; pp. 1–24.

* cited by examiner

METHOD AND APPARATUS FOR REMOVING OBSTRUCTIONS IN MINES

This application claims priority from U.S. Provisional Patent Application Serial No. 60/062,537, filed Oct. 17, 1997, and entitled "A Method and Apparatus for Removing Draw Point Blockages, Scaling Unstable Rock Formations and Breaking Free-Standing Boulders" and from U.S. Provisional Patent Application Serial No. 60/087,058, filed May 28, 1998, and entitled "Method and Apparatus for Removing Obstructions in Mines," which are incorporated fully herein in their entireties.

FIELD OF THE INVENTION

The present invention is directed generally to a method and apparatus for removing obstructions in mines and specifically to a system for removing rock blockages and/or oversized and/or unstable rock masses in mines and other types of excavations.

BACKGROUND OF THE INVENTION

In mining applications, it is common to encounter rock blockages of mine openings, such as shafts, adits, stops, drawpoints, and drifts, and oversized and/or unstable rock masses such as in large surface mining and quarrying operations. Such rock masses can interrupt production and pose an unsafe condition for employees.

The removal of such rock masses is not only extremely hazardous but also difficult. Typically, personnel must approach and inspect the rock mass, sometimes drill one or more holes into the rock mass, and implant explosives that will cause removal of the rock mass. People have been killed or seriously injured while performing these steps.

In designing a system for removing such rock masses, there are a number of considerations. First, the system should be capable of remote operation to reduce the hazards to personnel. In other words, the system should be capable of being controlled remotely (e.g., positioned, aimed, and/or fired remotely from the location of the system). Second, the system should be relatively inexpensive in the event that the rock mass, when released, buries the system. Third, the system must have a low rate of misfires. Fourth, the projectile fired from the system should disintegrate upon impact in the event that a misfire occurs and thereby dissipate the explosive charge and render harmless the undetonated explosive charge. Fifth, the system should be relatively accurate in striking the rock mass with the projectile over a substantial distance. Finally, the system should provide for ease of use, be of robust construction, and be simple in design and cost effective.

SUMMARY OF THE INVENTION

The present invention provides a system for launching a projectile to explode on impact and break rock in mines and other excavations. In one embodiment, the system includes:

(a) a projectile having:
  (i) a nose that is substantially flat or concave to inhibit deflection of the projectile from a face of the rock;
  (ii) a body containing an explosive charge; and
  (iii) a tail having a plurality of transversely oriented fins to control the trajectory of the projectile; and (b) a tube for launching the projectile. The system is simple and safe to use, cost-effective, of robust construction and highly effective and efficient in removing obstructions and enables accurate and remote shooting of rock masses, even of high rock hangups.

The body of the projectile contains a detonating device having a detonator inserted into its front end, a striker in its rear end, and a primer located between the detonator and striker. The striker and primer are separated from one another by a spring member which forces the striker away from the primer and a safety pin which restricts the motion of the striker towards the primer during shipping. The safety pin is removed before the launch of the projectile to permit the striker to impact the primer upon impact of the projectile with the rock face. Upon impact with the rock, the striker is forced forward with a sufficient force to overcome the resistive force of the spring and impact and ignite the primer which in turn ignites the detonator. The safety pin can be highly effective in preventing misfires of the detonating device during projectile assembly.

The relationship between the mass of the striker and the spring constant is an important consideration. Preferably the mass of the striker ranges from about 0.5 to about 7 grams and the spring constant from about 15 to about 30 lbs/inch.

The body of the projectile also contains an explosive charge, preferably castable, that is in contact with the detonating device. The explosive charge can be any suitable explosive and preferably is selected from the group consisting of TNT, PETN, RDX, HMX, ammonium nitrate-based explosives, and mixtures thereof.

The explosive charge and detonating device (which includes the detonator) are located in the forward section of the body to permit the charge and detonating device to be disintegrated upon contact with the rock mass. The walls of the body are preferably formed of plastic or another brittle material and have a thickness ranging from about 1 to about 6 mm to facilitate the disintegration of the projectile in the event of a misfire.

Typically, the detonator is inserted into the body of the detonating device immediately before the detonating device is inserted into the projectile. The detonating device (minus the detonator), the detonator, the projectile body and pusher plate, and the explosive charge are shipped separately and assembled at the site. This is done by placing the detonator in the detonating device; placing the detonating device into a passageway in the projectile body for holding the detonating device, and placing the explosive charge in the front of the projectile to form the fully assembled projectile.

The detonating device is received in a pocket in the body that permits the detonating device to move longitudinally and latitudinally in response to movement of the projectile. In this manner, the possibility of a misfire is significantly reduced, even at low flight velocities. The movement of the detonating device within the pocket will permit the striker to more readily impact the primer.

The body also can include a plurality of ribs to support the explosive charge upon impact with the rock mass. Preferably, 6 or more ribs are used to inhibit the explosive charge from deforming and flowing into the gaps between the ribs.

The center of gravity of the projectile is preferably located in the body section and the center of pressure preferably in the tail section to provide more desirable flight characteristics. Thus, the center of gravity and center of pressure are longitudinally of offset from one another along the longitudinal axis of the projectile. To accomplish this result, the outer diameter of the projectile body is no less than about 25% and no more than about 100% of the outer diameter of the tail section and the length of the projectile body is no more than about 50% of the length of the tail.

The launching tube includes a cavity at a bottom of the tube for containing a propelling charge for launching the projectile from the tube. The propelling charge is a suitable energetic substance such as a propellant or an explosive.

A pusher plate is located between the propelling charge and the bottom of the projectile. The pusher plate detachably contacts the bottom of the projectile. The pusher plate is a solid disk that substantially fills and substantially seals the portion of the tube below the pusher plate. As a result, a pressure differential exists across the pusher plate upon ignition of the propelling charge, with the pressure in the cavity beneath the pusher plate exceeding the pressure in the tube above the pusher plate. The pressure differential pushes the pusher plate and projectile from the tube at a velocity in excess of about 25 m/sec.

The firing tube and/or projectile can include remote control components to permit remote firing, arming, and detonation of the projectile. By way of example, the tube can include a receiver/transmitter for receiving a control signal from a transmitter held by an operator and transmitting a second control signal to a receiver in the projectile and/or to initiate the propelling charge and thereby fire the projectile. The projectile can include at least one receiver unit for receiving the control signal from the transmitter in the tube or the transmitter held by the operator. The receiver unit can in turn generate a control signal to pre-arm, arm, or initiate the detonating device. The projectile can also include one or more counters to determine a time interval after the firing of the projectile from the tube and provide a control signal to fully arm the detonating device or detonate the detonating device after a predetermined time interval has elapsed.

In another embodiment, the present invention provides a method for removing a body of rock in an excavation. The method includes the steps of:

(a) aiming a firing tube containing a projectile such that the projectile impacts a preselected target area on the rock body after launching;

(b) transmitting a control signal to a receiver from a remote location to cause at least one of the following to occur: firing of the projectile and arming of the projectile;

(c) firing the projectile from the tube; and (d) contacting the nose of the projectile with the target area.

Typically, the velocity of the projectile after leaving the tube is no more than about 250 m/sec and more typically ranges from about 25 to about 150 m/sec.

Aiming of the device underground or at night is relatively straightforward. A radiation emitting device, such as a flashlight or laser, is detachably mounted onto the tube and a light beam from the device is aligned with the desired target area to align the launching tube with the target. This methodology is highly accurate and reduces the likelihood that the projectile will miss the target area.

The method can further include steps to arm and detonate the projectile remotely. By way of example, the method can include the steps of transmitting a second control signal when the projectile is fired to a counter and when the counter determines that a predetermined time interval has elapsed, generating a third control signal to perform at least one of the following steps: closing a final arming switch for a detonating device in the projectile and initiating the detonating device to ignite an explosive charge in the projectile. The method can include the steps of converting the control signal into electrical energy and, when a predetermined amount of electrical energy is generated in the converting step, transmitting the electrical energy to a firing device to initiate the firing step or to an ignition device in the projectile.

DETAILED DESCRIPTION

Figure 1:
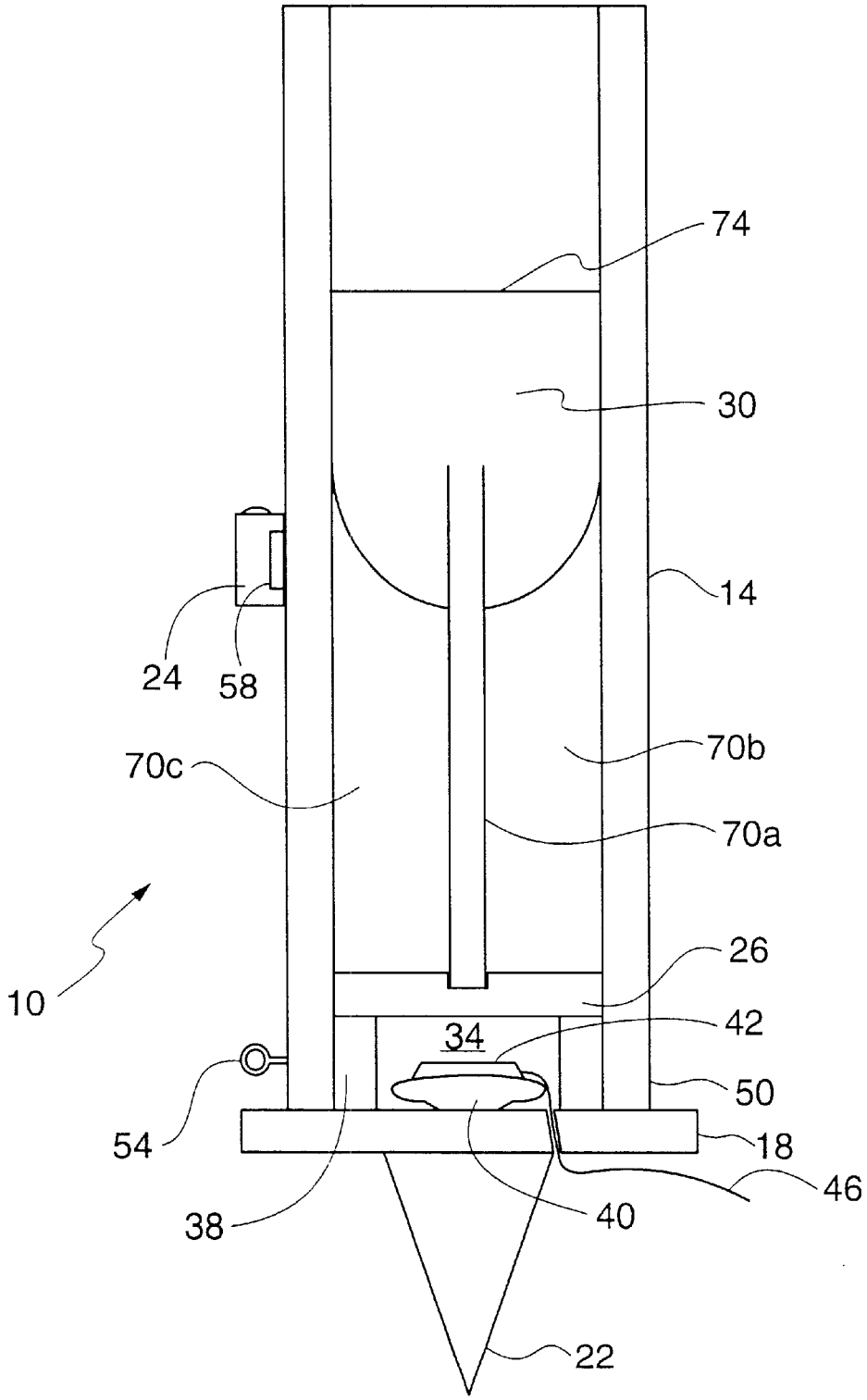
FIG. 1 is a cross-sectional view of a system according to the present invention.

Referring to FIGS. 1 and 9–11, a system 10 according to the present invention includes a launching tube 14, a base 18, an anchor spike 22, an aiming device 24, a pusher plate 26, and a projectile 30.

The base 18 further includes a cavity 34 located beneath the projectile 30 and pusher plate 26 containing a propelling charge 40 for launching the projectile 30 from the launching tube 14. The cavity 34 is formed by an inner tube 38 positioned inside of the launching tube 14 such that the walls of the inner tube 38 support the pusher plate 26. Accordingly, the outer diameter of the inner tube 38 is the same or less than the outer diameter of the pusher plate 26.

The propelling charge 40 is formed by an energetic material, such as a pyrotechnic (e.g., black powder) or a propellant, contained within a fabric, paper, and/or plastic pouch that is antistatic and/or water/moisture resistant. The pouch has a slit or pocket 42 into which an initiator is inserted. The initiator 46 for initiating the propelling charge passes through a hole 50 in the base 18.

The anchor spike 22 provides lateral and axial stability for the system through absorption of the launch thrust to permit the to be remotely launched without loss of the desired orientation (i.e., aim) of the tube. The spike, for example, can be forced into the ground or between supporting rocks. Rocks, sandbags, timbers, or other suitable objects can be placed under and/or around the launching tube 14 to hold the launching tube 14 in the desired position.

To permit the propelling charge to be placed in the cavity 34, the launching tube 14 is detachably connected to the base 18 and inner tube 38. A locking pin 54 (which passes through the adjoining walls of both the launching tube and inner tube) enables the launching tube 14 to be attached to or removed from the inner tube 38. As will be appreciated, the propelling charge is placed in the cavity when the launching tube 14 is detached from the inner tube 38.

The launching tube, base, and spike are preferably fabricated from suitable materials, such as a metal alloy or composite (e.g., steel or aluminum) or plastic to provide a robust construction and permit reuse of the system after each launching. As will be appreciated, after breakage rocks can bury the system or mining machinery may run over the system. In the former event, a chain or other suitable device (not shown) can be attached to the launching tube 14 or base 18 for retrieving the system from beneath the rocks for reuse.

The aiming device 24 is typically a light emitting device, such as a flashlight or laser, that is detachably mounted on the launching tube 14 to align the tube with the desired target. The device 24 has a circular saddle 58 having the same shape as the outer surface of the launching tube 14 to permit the device 24 to be seated onto the launching tube 14.

Figure 2:
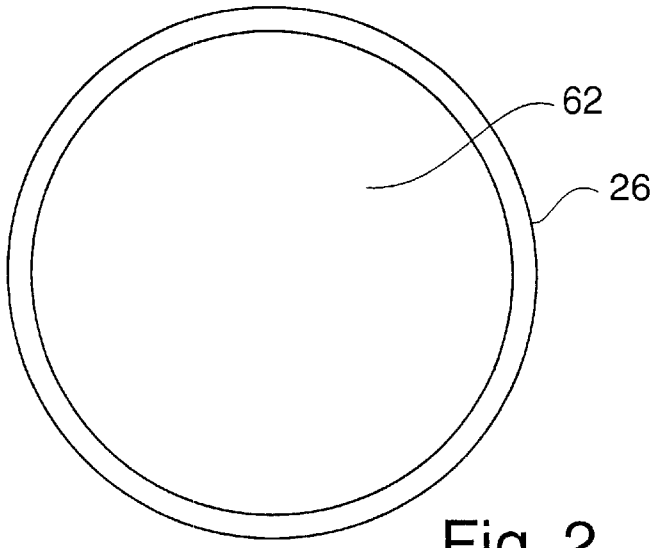
FIGS. 2–4 are various views of a pusher plate according to the present invention, with FIG. 2 being a bottom view, FIG. 3 being a cross-sectional view along line 3—3 of FIG. 2, and FIG. 4 being a top view.
Figure 3:
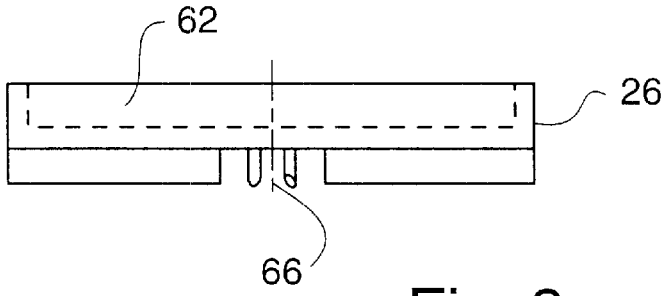
Figure 4:
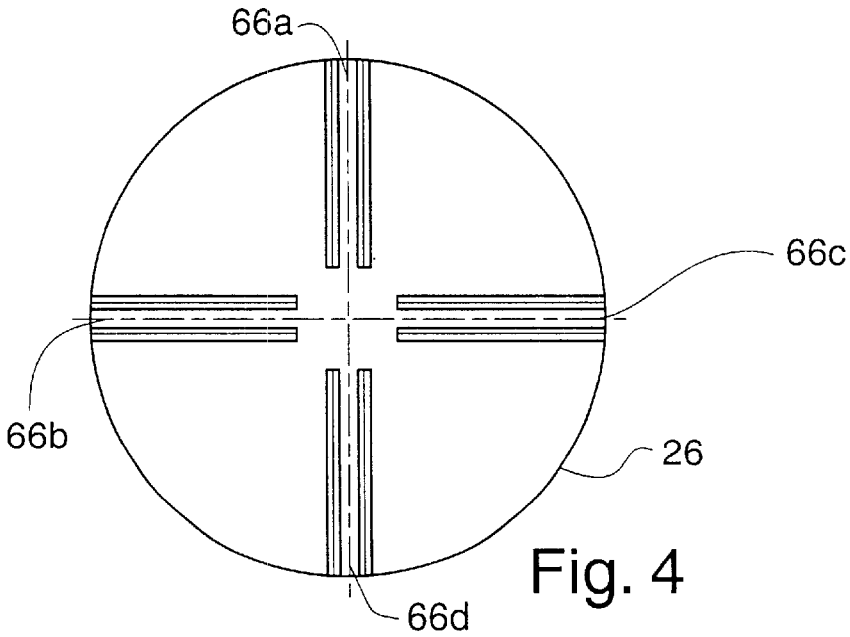

Referring to FIGS. 2–4, the pusher plate 26 is disc-shaped and has an outer diameter that is slightly smaller than the inner diameter of the launching tube 14 above the cavity 34. The gap between the outer circumference of the pusher plate and the inner wall of the launching tube is preferably no more than about 0.120" and more preferably no more than about 0.045" to facilitate the effective formation of a seal between the pusher plate and the walls of the launching tube. The pusher plate has a rear facing lip seal formed by an indented area 62 on the underside of the pusher plate 26 to improve gas pressure sealing in the launching tube 14, thus improving launch efficiency. The indented area 62 provides a pressure pocket beneath projectile to accelerate the projectile in the launching tube 14. The pusher plate 26 has a plurality of transversely oriented ribbed grooves 66*a–d* that are aligned with the fins 70*a–d* of the projectile 30. The grooves detachably hold the tailfins and therefore the projectile in position during launching and structurally support the tailfins during launching, thereby enabling higher pressures and launch velocities to be realized. Air resistance causes the pusher plate to separate from the rear of the projectile upon exiting the launching tube 14, thus enabling stable flight of the projectile to the target. The pusher plate 26 is typically not reusable and is formed from an inexpensive, lightweight material such as plastic. The pusher plate permits the projectile to be launched from the launching tube 14 using not only pyrotechnics but also compressed air or other gases.

FIGS. 1, 5A, 5C, 6, and 12 are various views of the projectile 30. The projectile 30 has a nose section 74, a body section 78, and a tail section 82. The nose section 74 is either substantially flat or concave to reduce the likelihood that the projectile will deflect from jagged or angled rock faces upon impact and thereby fail to detonate the explosive charge. The body section 78 contains the explosive charge 86 and the detonating device 90, which as noted, are each placed in the projectile body immediately prior to launch. The tail section 82 has a number of tail fins 70*a–d* to stabilize the trajectory of the projectile. The projectile body can be made from a wide variety of inexpensive and lightweight materials, with injection molded plastics being most preferred.

The body section 78 has a rounded or shaped rear 94 transitioning into the tailfins 70*a–d* to provide airflow transition over the projectile body during flight. As will be appreciated, the rear 94 can also be angled downwardly towards the tailfins to achieve the same purpose.

To provide desired flight characteristics, it is preferred that the center of gravity of the projectile be located in the body section and the center of pressure in the tail section. To realize this configuration, the diameter of the tail is preferably no less than about 25% and more preferably no less than about 50% and no more than about 100% and more preferably no more than about 75% of the diameter of the body, and the length "L" of the tail is preferably at least about 60% and more preferably ranges from about 70 to about 80% of the total length "$L_T$" of the projectile 30.

The body section 78 has a plurality of internal ribs 70*a–d* to support the explosive charge 86. The projectile has at least six and more preferably at least eight internal ribs 98*a–h* located on the interior surface of the rear 94 to support the explosive charge 86 during launch without requiring a separate pressure spreader plate to prevent the explosive charge from being fragmented during launch acceleration.

Figure 8:
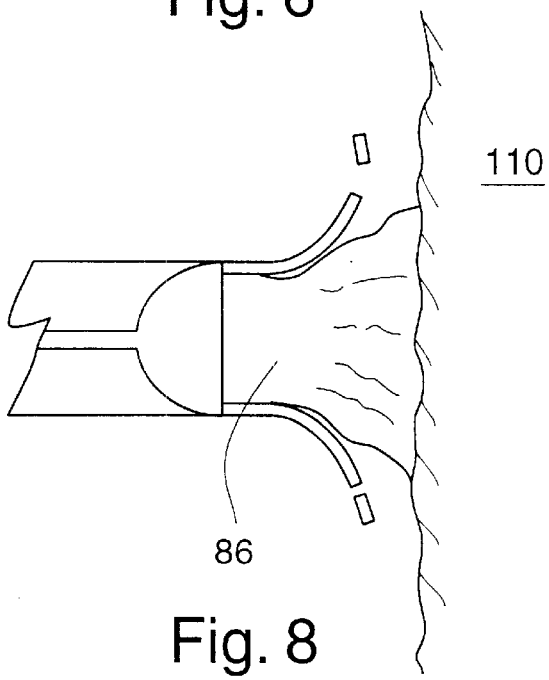
FIG. 8 is a view of the projectile impacting a rock face.

The explosive charge 86 is preferably a cast explosive, such as "PENTOLITE," "COMP-B", or any other suitable castable explosive that has a high velocity of detonation. The charge 86 is exposed in the nose section 74 and, as shown in FIG. 8, becomes deformed upon contact with the rock face 110 before the detonating device 90 is initiated. This provides excellent transferral of the shock wave from detonation of the explosive charge into the rock.

In the event of a misfire (e.g., through the detonating device failing to initiate), the structural strength of the projectile 30 is designed so that the nose section will shatter upon impact with the rock face and the projectile explosive charge 86 will disintegrate into a granular powder, thereby rendering the unexploded charge harmless to personnel and equipment. Accordingly, the thickness of the outer wall surrounding the body section 78 ranges from about 1 to about 6 mm and more preferably from about 2 to about 5 mm to provide a sufficient strength to withstand the pressures exerted by the explosive charge on the walls during flight while maintaining the strength of the walls low enough to permit the front portion of the projectile to disintegrate upon impact in the event of a misfire. The ribs 98*a–h* in the body section 78 are also designed to provide particular reinforcing to the body section 78 to attain the particular crushing characteristics necessary to ensure the explosive charge is fully disintegrated in the event of a misfire.

Figure 7:
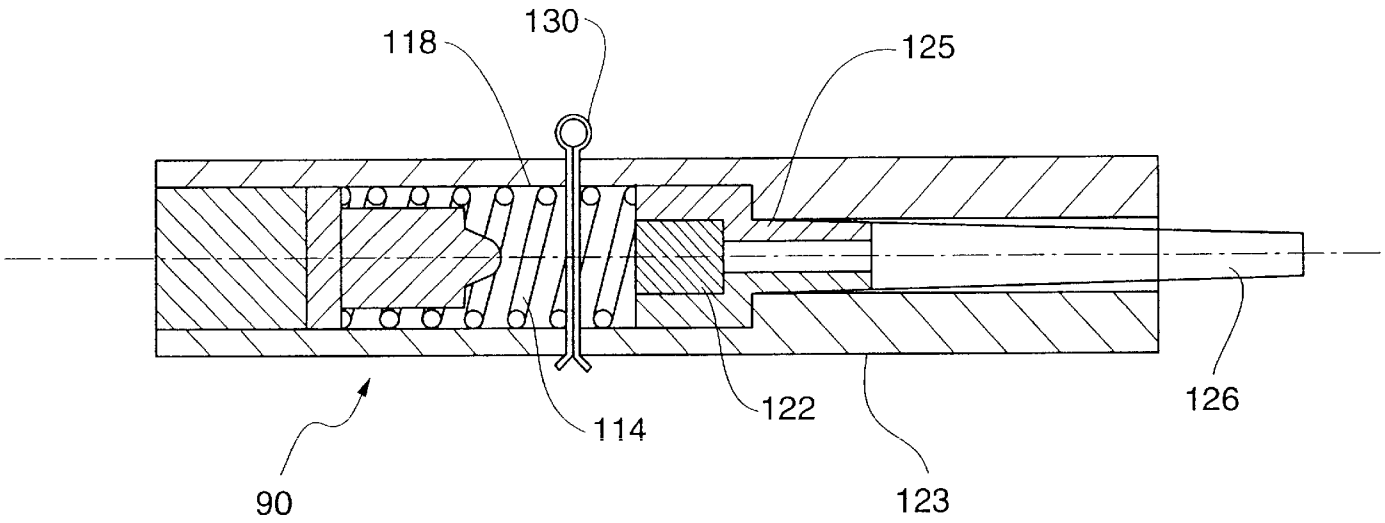
FIG. 7 is a cross-sectional view of a second configuration of the detonating device.
Figure 9:
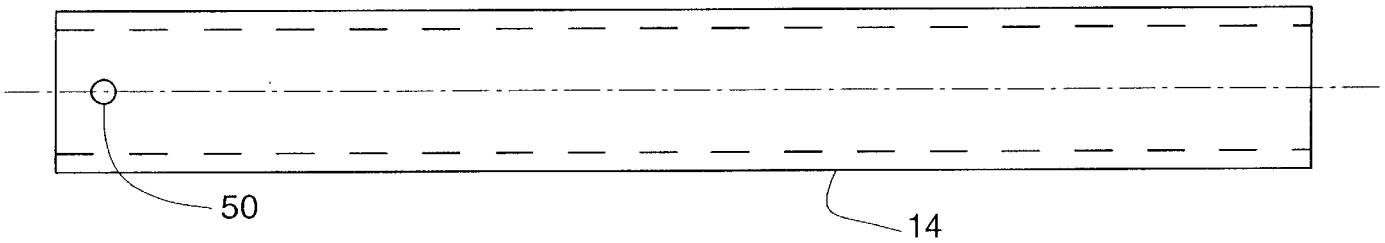
FIG. 9 is a side view of the detached launching tube.
Figure 11:
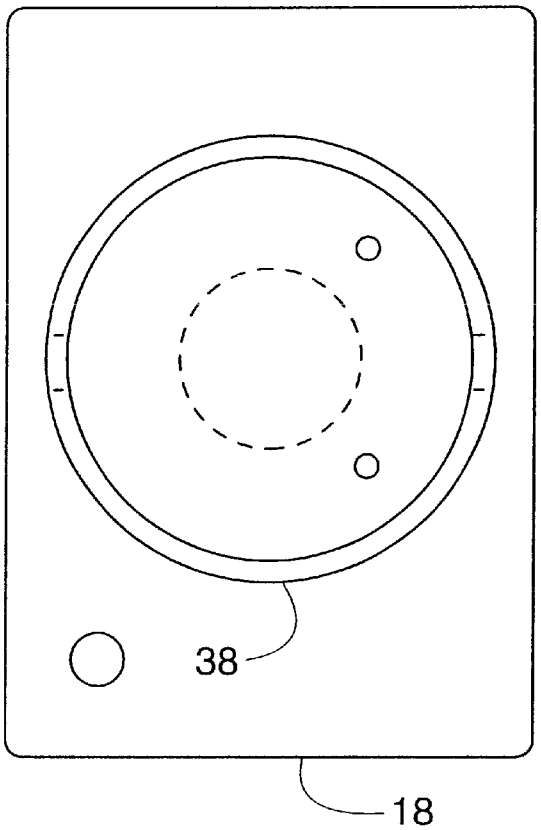
FIG. 11 is a top view of the base.
Figure 10:
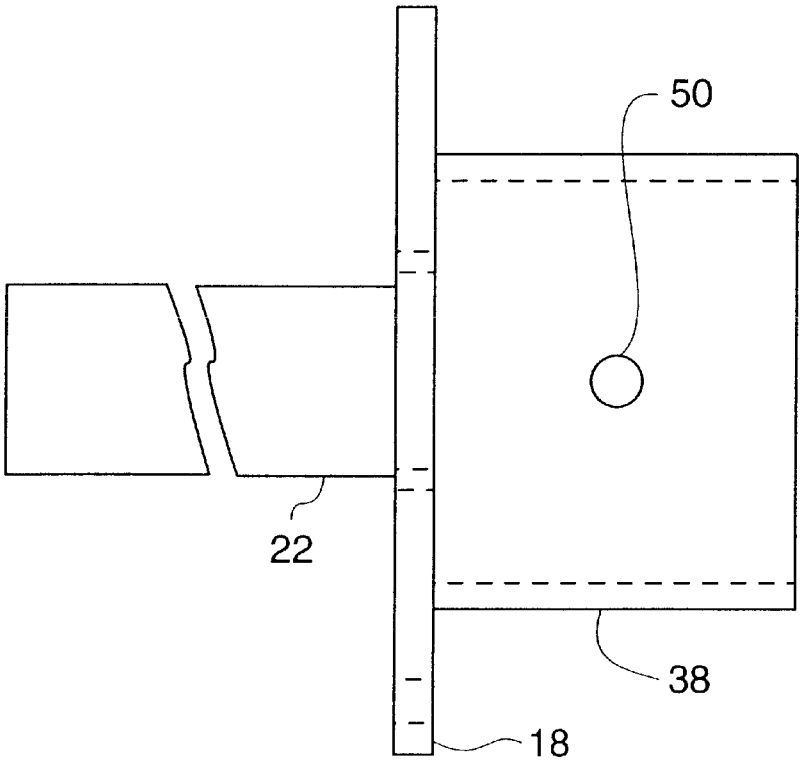
FIG. 10 is a side view of the base.
Figure 12:
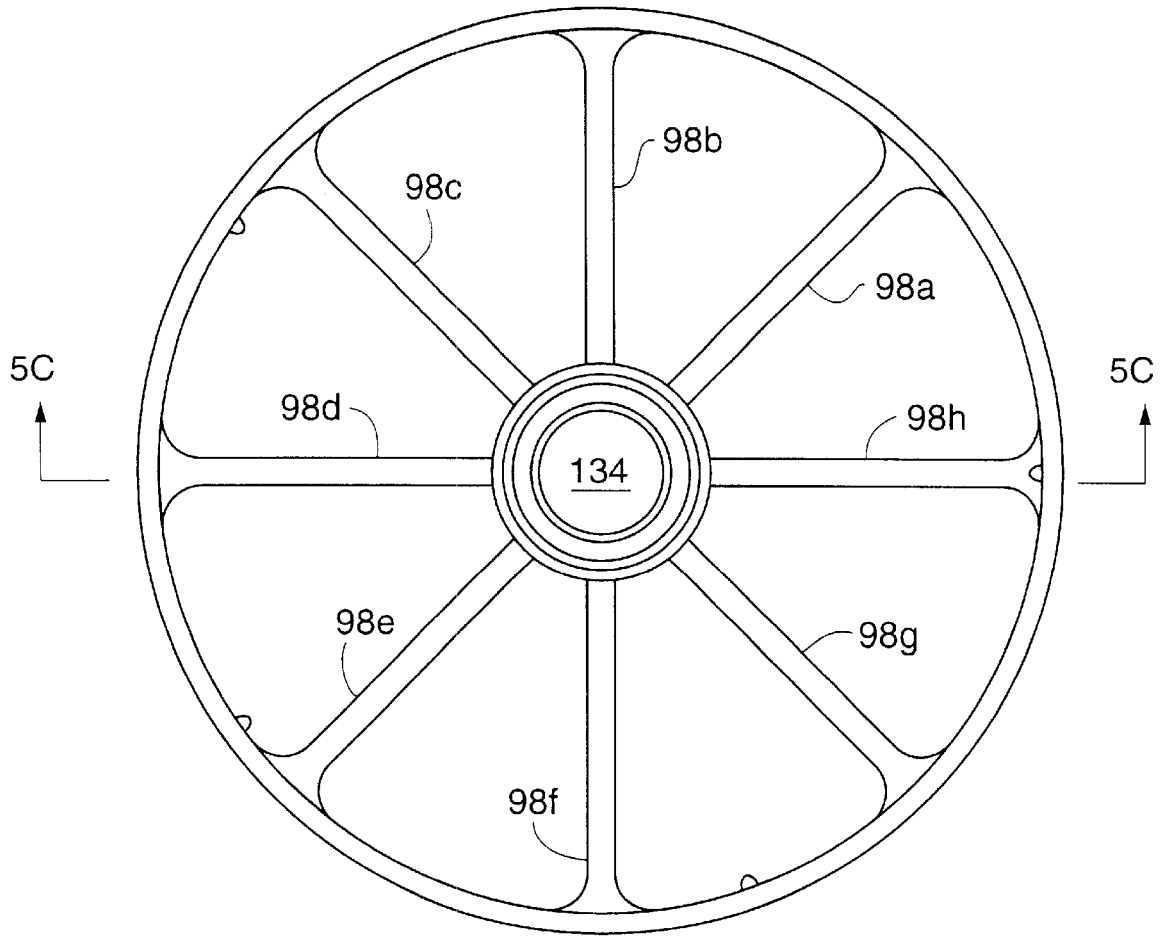
FIG. 12 is a top view of the body without the explosive charge present.

A cross-sectional view of a configuration of the detonating device 90 is presented in FIG. 7. The detonating device 90 includes a striker 114, a spring member 118 biasing the striker 114, a primer 122, a detonator 126, a safety pin (e.g., a Cotter pin) 130 separating the striker 114 from the primer 122, a detonator holder 125, a rear plug 127, and a detonating device body 123. The striker, which is typically composed of a metal or plastic, is movably mounted in the detonating device 90 so that the striker can move forwardly in the detonating device body 123. When the projectile impacts a rock face, the striker 114 overcomes the spring member 118 bias and then impacts the primer 122. The primer 122 initiates and in turn initiates the detonator 126 which in turn initiates the explosive charge 86. During shipping of the detonating device (minus the detonator), the safety pin 130 prevents the striker 114 from contacting the primer 122 and thereby prevents accidental initiation of the impact fuze. This feature enables the detonating device to have a UN 1,4S transport safety classification.

The detonating device 90 is movably and loosely mounted in a detonating device passageway 134 to permit the detonating device to experience some lateral (side-to-side) and longitudinal (end-to-end) movement. This is accomplished by having a gap between the outer walls of the detonating device 90 and the inner walls of the detonating device passageway 134. It has been discovered that the gap provides more reliable initiation compared to a detonating device that is securely held in a fixed position in the passageway. The gap between the side wall of the detonating device and the side wall of the pocket preferably ranges from about 0.5 to about 4.0 mm. The detonating device 90 is further capable of moving back-to-front by contacting with the explosive charge. Preferably, the detonating device volume ranges preferably from about 45 to about 90 percent of the pocket volume; the length of the detonating device ranges preferably from about 75 to about 100% of the length of the pocket 90; and the width of the detonating device ranges preferably from about 65 to about 95% and more preferably from about 75 to about 85% of the width of the pocket device 90.

Figure 5A:
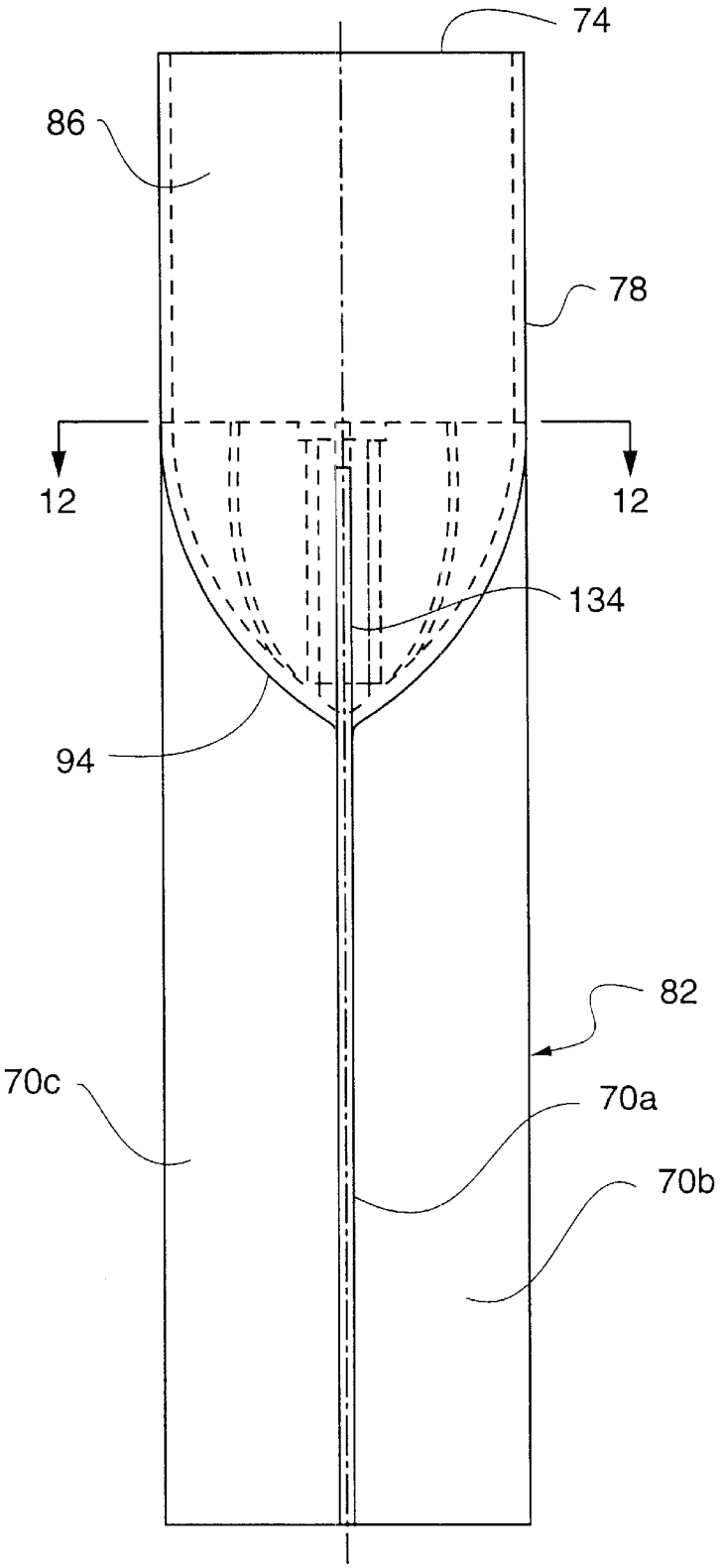
FIGS. 5A–C are various views of a projectile according to the present invention, with FIG. 5A being a side view of a projectile, FIG. 5B being a side view of a first configuration of the detonating device, and FIG. 5C being a cross-sectional view of the projectile taken along line 5C—5C of FIG. 12.
Figure 5B:
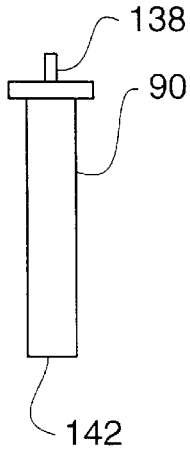
Figure 5C:
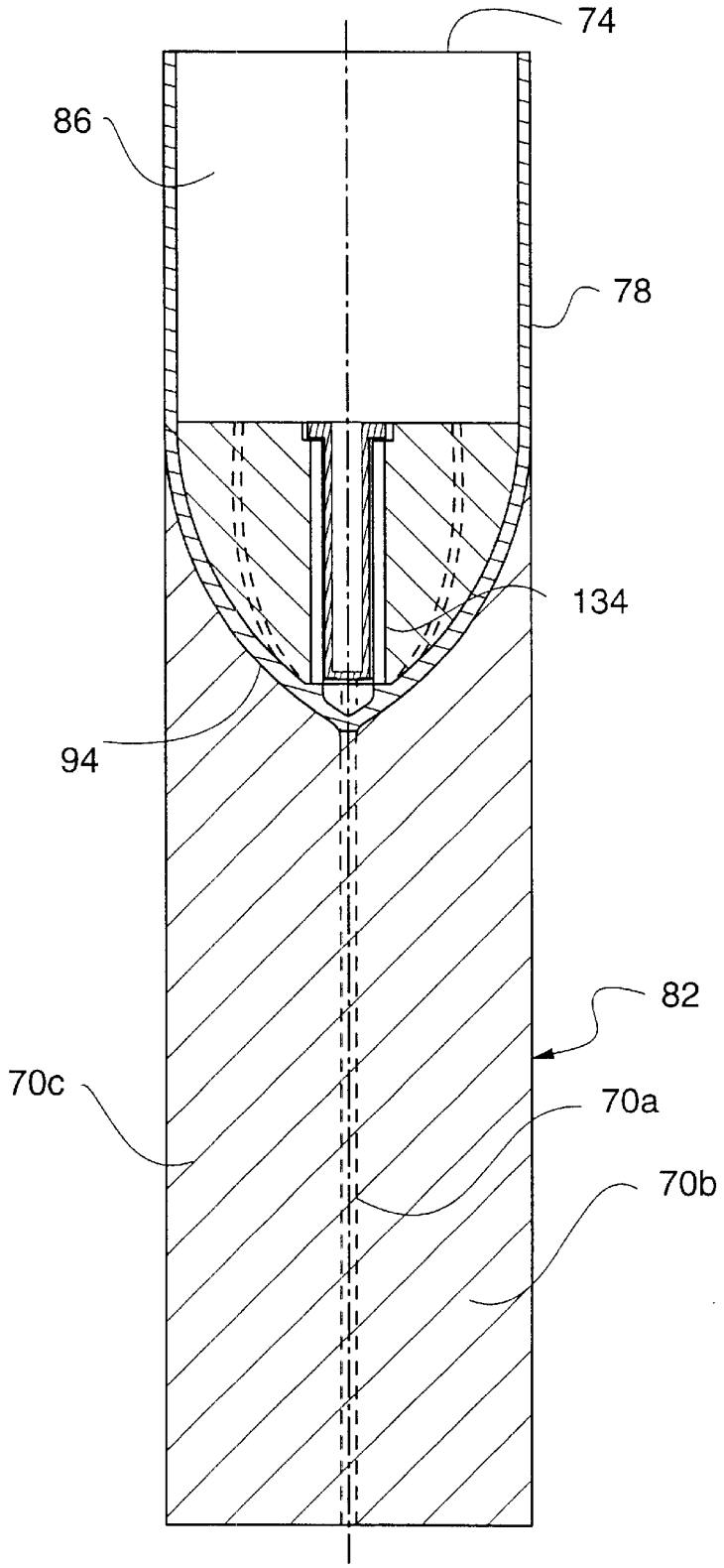
Figure 6:
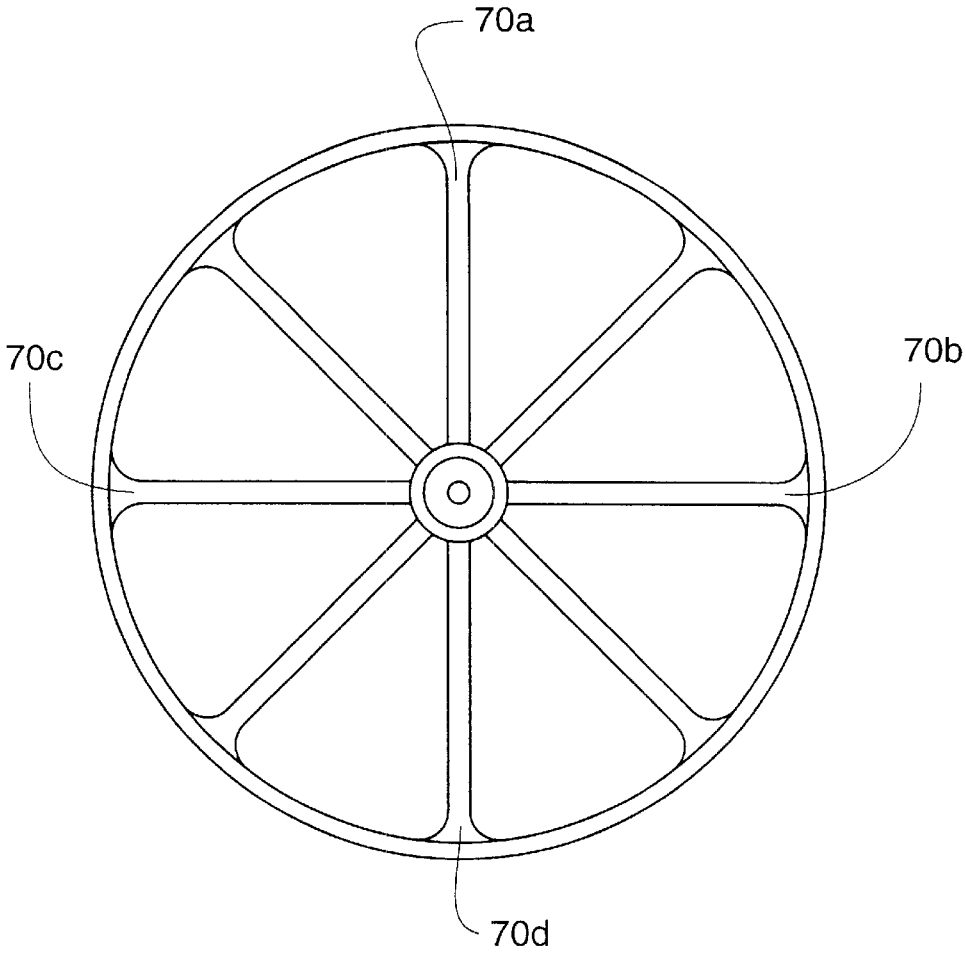
FIG. 6 is a bottom view of the projectile.

Additionally, in a second detonating device configuration shown in FIG. 5B, the detonating device 90 has a wider front end 138 than a back end 142 which permits the detonating device to be inserted into the detonating device passageway 134 only in the correct orientation. This prevents incorrect assembly.

The operation of the system will now be discussed. Prior to aiming the tube, the launching tube 14 is removed from the inner tube 38 and base 18, the propelling charge 40 is placed in the cavity 34 in the inner tube 38, the initiator 46 connected to the propelling charge is run through the hole 50, the launching tube 14 is reattached to the inner tube 38 and base 18, the locking pin 54 is inserted to lock the launching tube and base into position, and the anchor spike 22 is backstopped by rocks or pushed into the ground. To aim the launching tube, the aiming device 24 is placed on the launching tube, a light beam is emitted from the aiming device 24, and the launching tube repositioned until the light beam illuminates the desired target area. The aiming device 24 is removed from the launching tube once the launching tube and base are secured in the aimed position.

The projectile is assembled by first inserting the detonator into the open end of the detonating device, placing the detonating device into the detonating device passageway, and placing the explosive charge in the front of the projectile.

The pusher plate 26 is engaged with the bottom of the tailfins 70*a–d* and the assembled projectile 30 and attached pusher plate 26 are placed pusher plate-first into the launching tube. The launch area is then evacuated. The propelling charge 40 is then initiated using appropriate procedures (e.g., a remote control device, an electric or nonelectric impulse, or a match) and the projectile is launched from the tube.

When the projectile impacts the target area, the explosive charge is deformed somewhat to match the shape of the rock face and the force of contact between the projectile and the rock face propels the striker 114 forward with a force sufficient to overcome the resistance of the spring member 118. The pointed end 200 of the striker then impacts and initiates the primer 122 which fires into and initiates the detonator 126. Initiation of the detonator in turn detonates the explosive charge 86 which fragments the rock face to be broken.

In a second embodiment of the present invention, the system can include one or more of a mobile unit for transporting and positioning the tube, transmitting, receiving, collecting units to permit remote operation of the system, and/or remote viewing devices for aiming the tube from a location that is a distance from the tube.

An important aspect of the second embodiment is the use of electromagnetic energy, such as encrypted radio signals, which allow an operator to remotely and safely control the operation of the system from the initiation of the launcher to the final disposition of the explosive charge in the projectile, without accidental initiation by other unrelated, sources of radio frequency which are common in mining and construction operations.

As noted, the system according to the second embodiment can include one or all of the following components in addition to the system discussed above:

Mobile carrier or other suitable platform

Remote viewing device

RF Controller/Transmitter

RF Receiver/Transmitter

RF Receiver/Collectors in the projectile and propelling Charge

Figure 13:
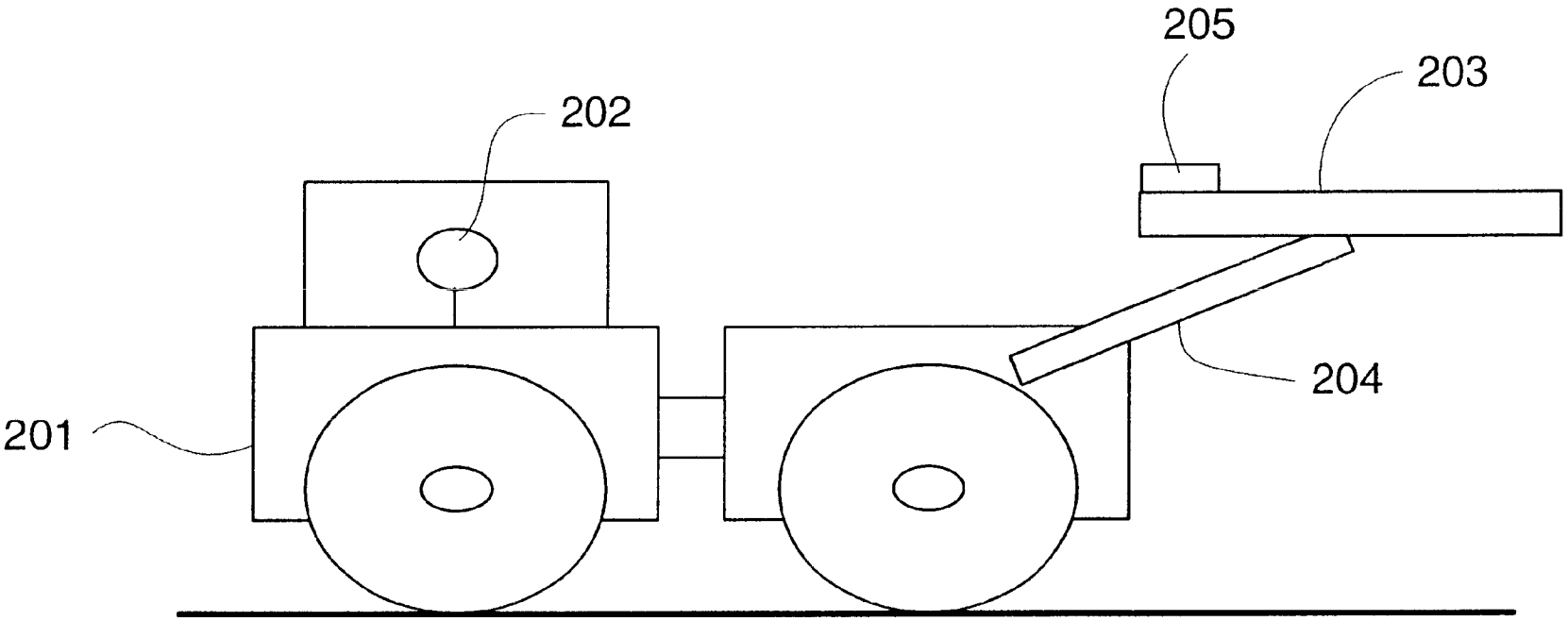
FIG. 13 is a side view of an apparatus according to a second embodiment of the present invention.

The carrier may be a modified mining machine or other suitable carrier. The carrier is modified to mount a launch tube that can either be (1) positioned and aimed at the target rock mass by positioning cylinders or (2) dropped into position and decoupled from the carrier by a quick-hitch or other suitable arrangement. The latter allows the carrier to be moved back out of harm's way if a substantial rock slide is expected when the target rock mass is fragmented. FIG. 13 shows a typical load-haul-dump (LHD) carrier with a launch tube mounted on its front end.

Figure 14A:
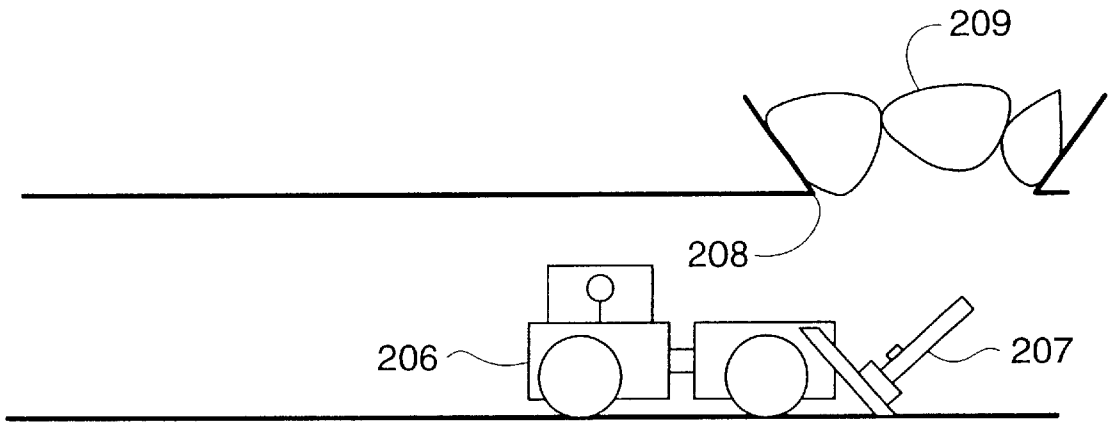
FIGS. 14A and 14B are side views of the apparatus of FIG. 13 being positioned beneath a hang up.
Figure 14B:
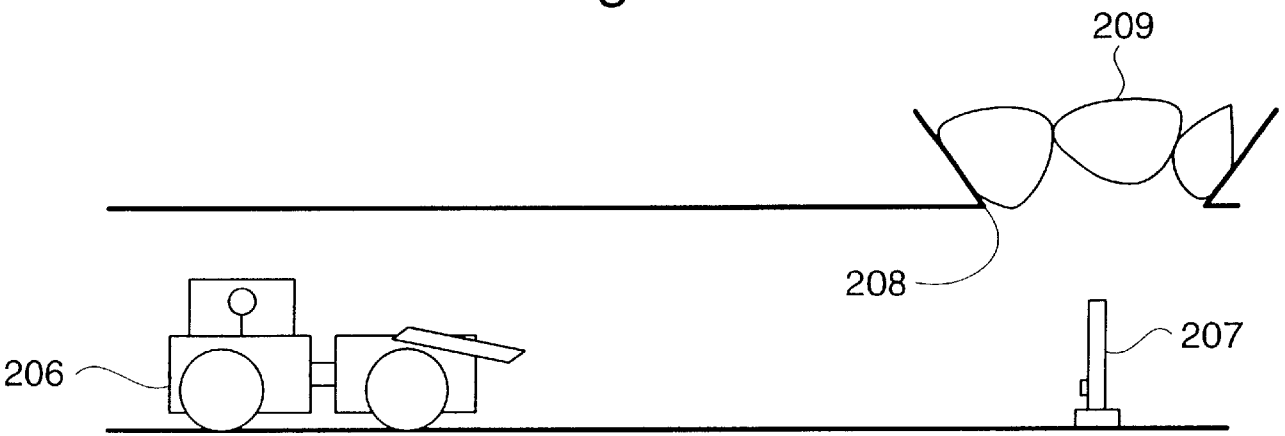

The carrier would be positioned for a shot or would position the launch tube for a shot such as depicted in FIGS. 14A and 14B. Once positioned, the operator would move to a safe place to fire the launcher.

The remote viewing device can be used to safely observe the target rock mass without personnel moving into the danger zone where an unstable rock mass can suddenly break loose. In some instances, there will be a line-of-sight to the target rock mass (for example, in drawpoints where the blockage is below the brow, free-standing boulders or unstable rock walls in open-pits). In other instances, the target rock mass may not be visible (for example, a high drawpoint blockage well about the brow of the drawpoint). In either instance, the remote viewing means include remotely operated cameras or fibre optics. The camera or other means of remote viewing can be mounted on either the carrier or launch tube and used to obtain an image of the target rock mass. This camera may be controlled by the operator as described below.

The RF Controller/Transmitter is envisioned as a hand-held unit that the operator carries on his person. The controller contains an RF Transmitter capable of communicating with a Receiver/Transmitter located either on the carrier or on the launch tube. The Controller/Transmitter is capable of transmitting a signal over a short range of up to several hundred meters. The Controller/Transmitter contains the electronics, special silicon chips and associated software to allow the operator to send encrypted instructions to the RF Receiver/Transmitter. The Controller/Transmitter includes safety switches to prevent accidental operation, a keyboard for entry of keycodes and other instructions and software codes that only the operator can activate. The keycodes or encryption codes can be changed from time to time to ensure continued security.

In a modern mine, there are many sources of RF noise associated with mine communications, cell phones, engine noise from large machines and computers. One of the principal safety features of the RF Controller/Transmitter that is part of the present invention is that the RF signals to be transmitted will be encrypted such that the Receiver/Transmitter will only respond to these encrypted signals and not to other extraneous RF signals including those on the same carrier frequency.

The RF Receiver/Transmitter is located on the carrier or on the launch tube. This unit receives encrypted control signals from the RF Controller/Transmitter and retransmits them to an RF Receiver/Collector on board the projectile in the launch tube and to a unit associated with the projectile propulsion system. This unit may also be used to receive and retransmit control signals for controlling the position of the launch tube and/or controlling a remote camera or fibre optics unit used to view the target rock mass.

When the Receiver/Transmitter issues the "launch" command, it sends encrypted instructions to the projectile to cause the fuze in the projectile to activate, energize and pre-arm itself. It also sends encrypted instructions to the Receiver/Collector unit that initiates the projectile propulsion system.

A Receiver/Collector unit can be located not only in the propelling charge but also in the projectile. In either case, one or more Receiver/Collector units is used on each shot and so the units are considered a consumable item and are preferably low cost.

The Receiver/Collector unit located in the propelling charge (for example, a cartridge containing a load of smokeless powder, an electric match and a small initiation charge) is activated when it recognizes an encrypted signal to power up and launch the projectile. Upon receiving this signal, the unit begins to collect and convert electromagnetic energy into electrical energy which is stored in an electrical storage device such as a capacitor. When the chip in this unit determines that the correct charge is stored, it generates a control signal to initiate the propelling charge to launch the projectile.

Alternately, the Receiver/Transmitter unit on the carrier or launch tube can directly fire the projectile by opening a solenoid operated valve that discharges compressed air into the launch tube behind the projectile. Alternately, the Receiver/Transmitter unit on the carrier or launch tube can directly fire the projectile by activating an electric solenoid to discharge a compressed gas cartridge.

The Receiver/Collector unit located inside the projectile is used to activate, energize, arm and control the operation of the fuze that initiates the explosive charge on board the projectile. This unit is activated when it recognizes an encrypted signal to power up. Upon receiving this signal the unit begins to collect and convert electromagnetic energy into electrical energy which is stored in an on-board electrical storage device such as a capacitor. When the chip in this unit determines that the correct charge is stored, it generates a control signal to pre-arm the fuze in the explosive load (the final arming is carried out after the projectile exits the launch tube). The electrical storage device retains sufficient charge to operate additional arming and control functions that occur after the launch and during the subsequent flight of the projectile.

Figure 17:
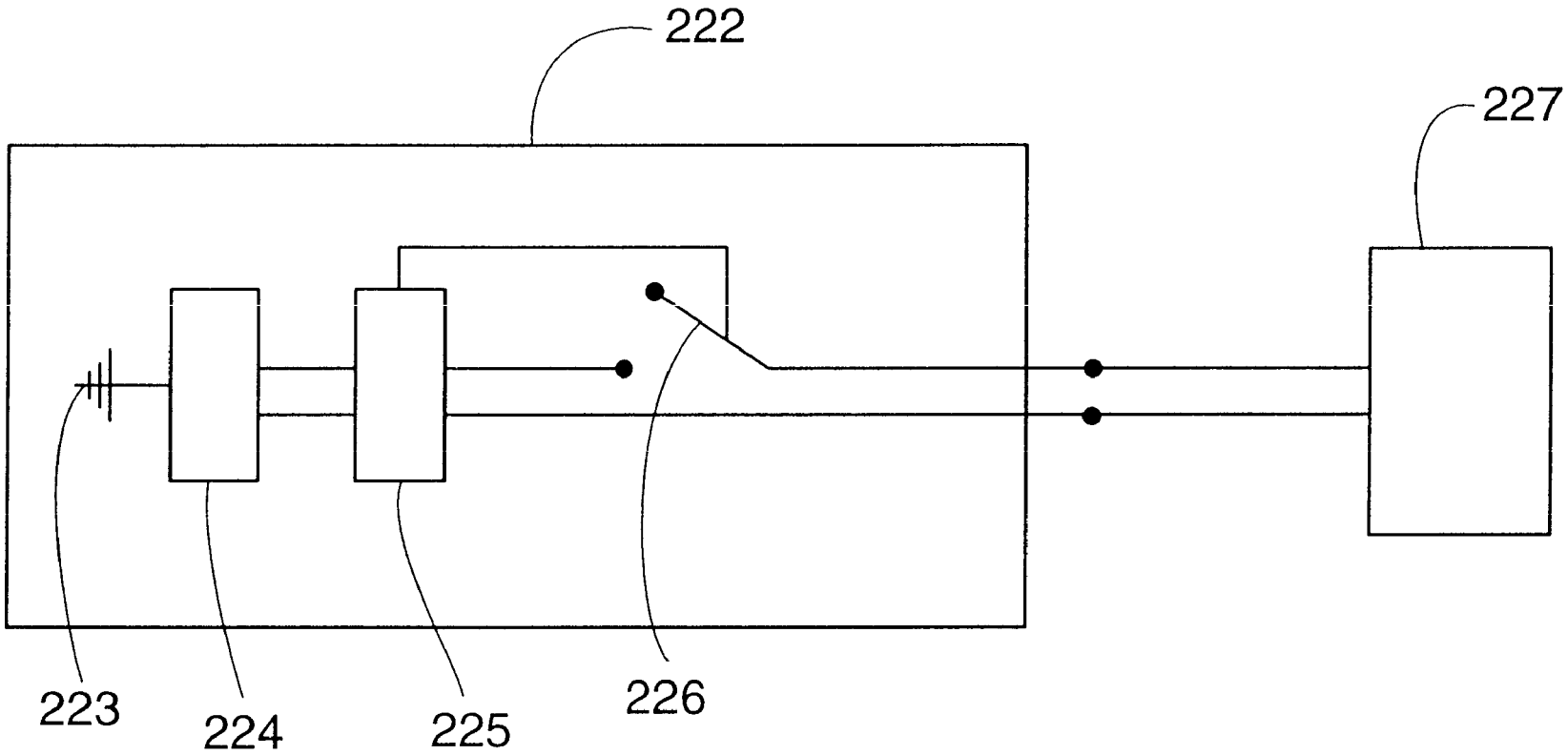
FIG. 17 is an electrical flow schematic of the elements within a Receiver/Collector unit that fires the propelling charge.
Figure 18A:
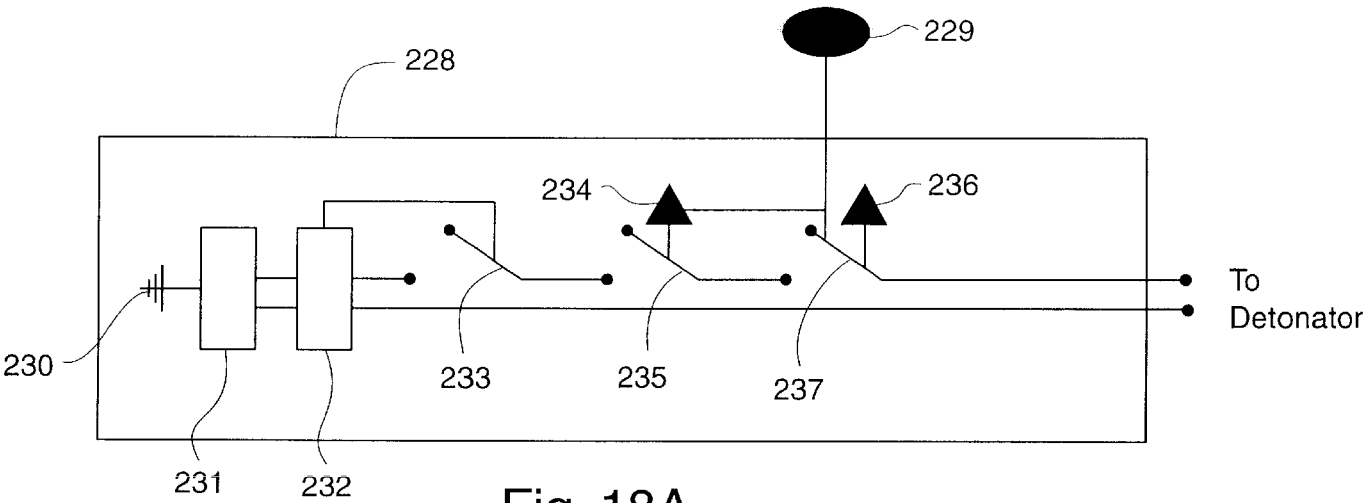
FIGS. 18A and 18B are electrical flow schematics of the element(s) within the Receiver/Collector unit(s) that controls the arming and fail-safe operation of the fuze or primer in the explosive charge.
Figure 18B:
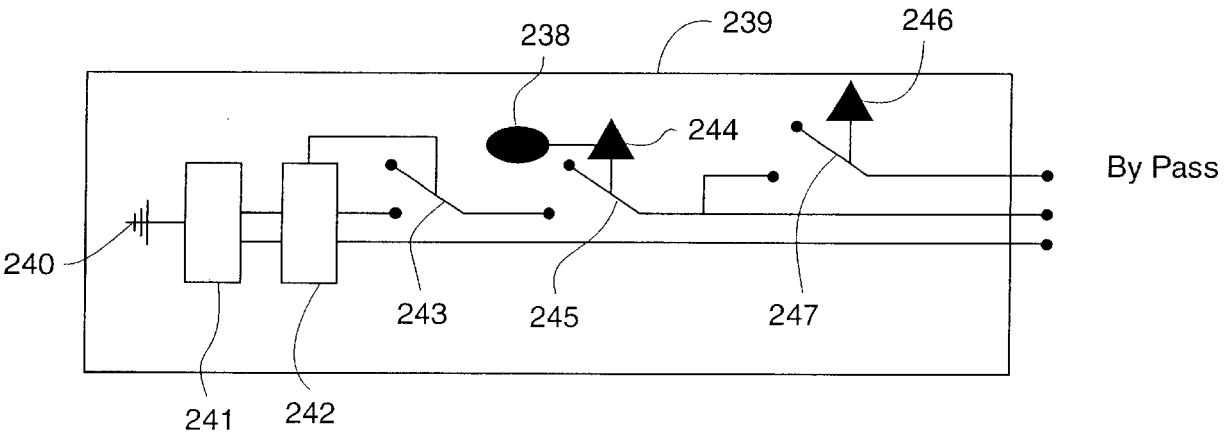

The functional elements of the Receiver Collector for the propelling charge are shown in FIG. 17. The functional elements of the Receiver/Collector located in the projectile are shown in FIGS. 18A and 18B.

The electronic, radio-controlled fuze or detonating device can be used in preference to the detonating device discussed above and is the heart of the system. Many important safety functions are built into the detonating device. First, the projectile contains a substantial explosive charge and may even carry its own propelling charge. When the operator unpacks the projectile, transports it and loads it into the launch tube, the explosive, and, if used, the propelling charge, are in an inert state and incapable of discharging accidentally. Second, when the projectile is launched, the explosive charge initiates after the projectile has been launched and regardless of what type of impact situation is encountered. As noted above, the impact of the projectile may be onto an oblique surface and this raises the possibility that the projectile fuze may not go off. Since the obliqueness of the impact cannot be controlled and the possibility of unexploded rounds becomes a safety concern, the system of the second embodiment not only uses a projectile that disintegrates upon impact but also a projectile that includes one or more fail-safe devices such as timing counters. These units contain a small sensor which detects the force of launch. This sensor will not be activated until the fuze has been pre-armed and therefore cannot be activated accidentally prior to the receipt of the encrypted firing command. Once this sensor (which may be a piezoelectric, mechanical or electronic sensor) detects the launch force, it activates one or more counters. A first counter is set to close the final fuze arming switch after a time sufficiently long for the projectile to clear the launch tube. This prevents accidental initiation of the explosive charge during the launch cycle. Now the projectile is in flight and fully armed. A second counter is set to detonate the explosive charge in the projectile after a time sufficiently long that the projectile should have reached its target rock mass. This is a fail-safe feature that ensures that there will be no un-detonated explosive in the rock mass. Alternately the second counter can be started after the first counter has expired (that is, after the projectile has cleared the launch tube). The choice is programmable in the Receiver/Collector chip.

Figure 19A:
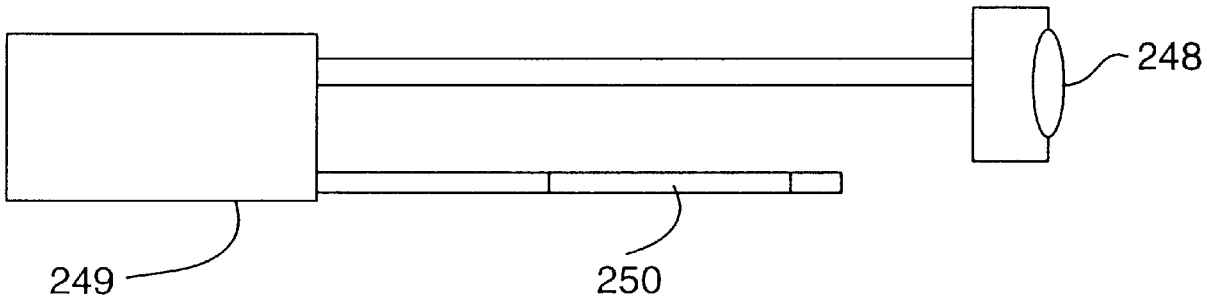
FIGS. 19A and 19B are electrical flow schematics of an alternate fuze configuration for initiating the explosive charge when the projectile impacts the target rock.
Figure 19B:
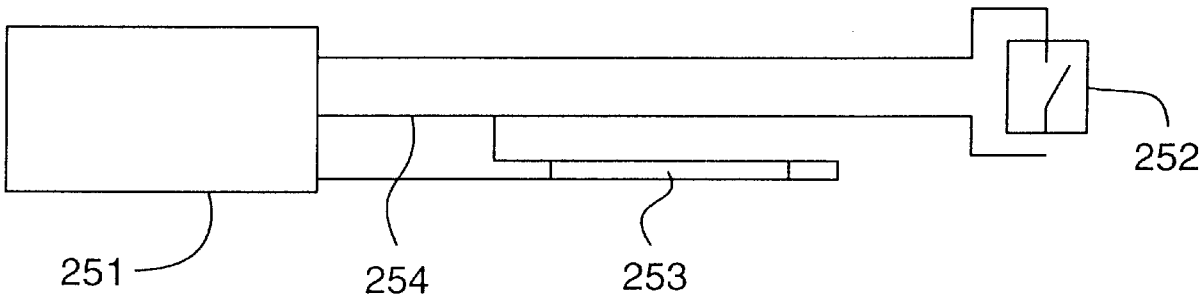

In an alternative configuration of the detonating device, the detonating device or fuze itself may be comprised of an electric detonator or electric match or other small explosive initiating device connected to an arming and firing circuit. The fuze can include a sensor or closing switch which is activated by the impact of the projectile. The sensor or closing switch is sensitive enough to operate upon an oblique impact or change in direction of the flight of the projectile. Examples of both types of fusing system are shown in FIGS. 19A and 19B. There may be one or several fuze assemblies in the projectile all controlled by the Receiver/Collector chip. The control logic for fuze arming (one or more arming stages) and the electrical energy for activating the fuze are stored on the Receiver/Collector chip on board the projectile. In the second embodiment of the present invention, fuze arming is accomplished remotely by the operator sending an encrypted signal from his RF Controller/Transmitter unit. The operator may be required to install the fuze into the projectile, but at no time will there be an energy source in the projectile capable of arming or initiating the fuze.

The innovation of the present invention is best understood in terms of its operational sequence. FIGS. 20A–20E together show the sequence of the carrier positioning the launch tube for removing a drawpoint blockage. In both cases of positioning the launch tube while attached to or detached from the carrier, the propelling and fusing system are completely deenergized and incapable of accidental initiation. The projectile and propelling charge have been loaded into the launch tube prior to the carrier being moved into position.

The operator now moves to a safe firing position. He may use his hand-held RF Controller/Transmitter unit to remotely observe the target rock mass (if a remote viewing system is used) and to further aim the launch tube (if remotely operated systems are used).

Once the launcher is positioned, armed, and ready to be launched, the operator issues an encrypted launch command to the RF Receiver/Transmitter located on the carrier or the launch tube. The sequence of events that follow the sending of the launch command are depicted schematically in FIGS. 21A–F. The outcome of the launch command is the launching of the projectile and the detonation of the explosive charge either by impact with the target rock mass or by the fail-safe self-destruct command issued from the Receiver/Collector unit on board the projectile.

A more detailed discussion of FIGS. 13–21 is now presented. FIG. 13 shows a carrier 201 tramming along an underground drift driven by an operator 202. A launch tube 203 is shown mounted or removably held on the front of the carrier 201 by a quick-hitch hydraulic release mechanism 204. An RF Receiver/Transmitter unit 205 is attached to the launch tube 203. The operator 202 carries a hand-held RF Transmitter/Controller unit (not shown) that communicates with the RF Receiver/Transmitter unit 205.

FIGS. 14A and 14B show a sequence of frames depicting the remote setup of the launch tube into launching position. In FIG. 14A, a carrier 206 with a launch tube 207 attached to the front end of the carrier 206 moves into position under the brow of a drawpoint 208. A number of large boulders 209 block the drawpoint 208. In FIG. 14B, the carrier 206 has disconnected and set down the launch tube 207 under the drawpoint 208 beneath the unstable blockage 209. The carrier 206 has moved back down the drift to a safe location.

Figure 15:
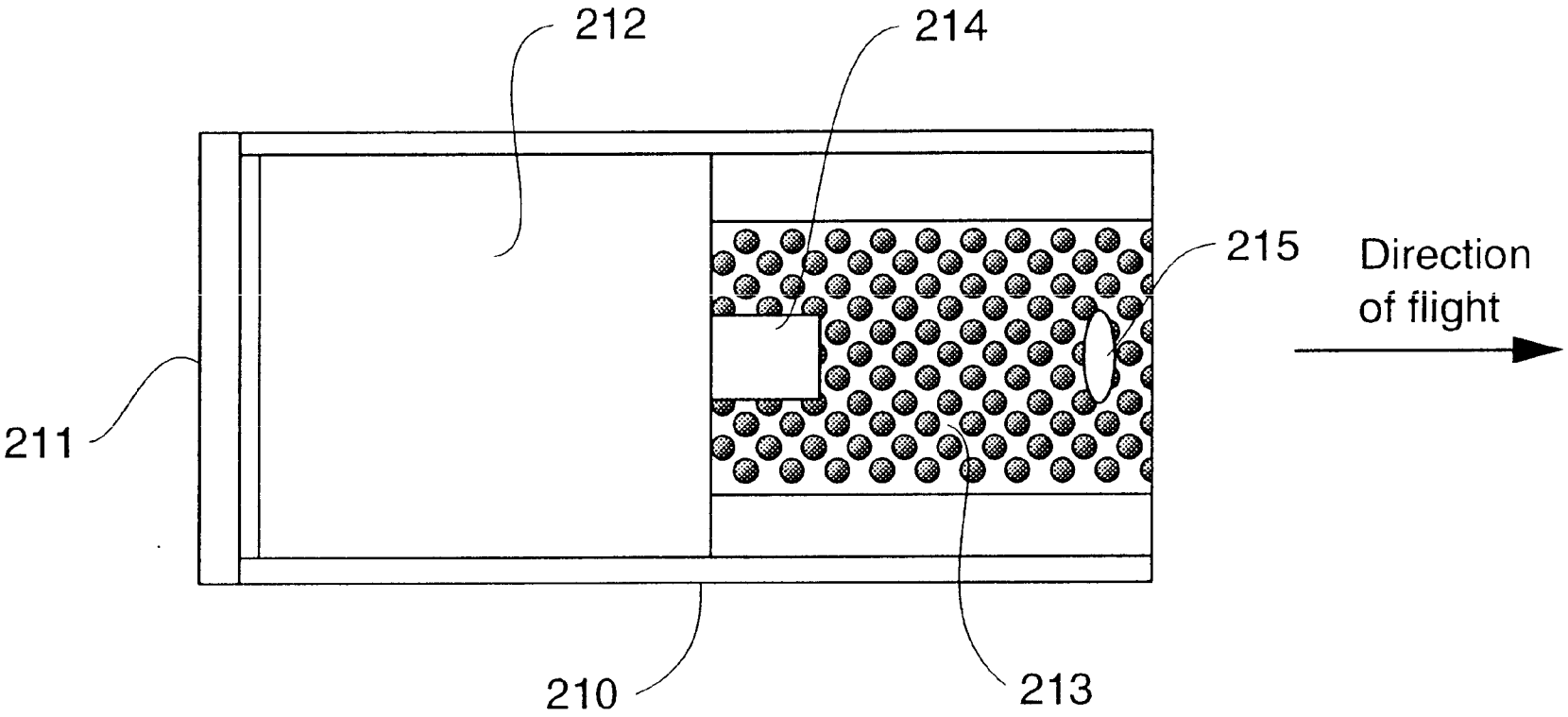
FIG. 15 is a cross-sectional view of a projectile according to a second projectile configuration.

Another configuration of a projectile is shown in FIG. 15. The projectile is comprised of a body shell 210 and a pusher plate 211 of sufficient thickness to withstand launch pressures typically as high as 500 psi (3.5 MPA). The rear portion of the body is filled with an inert filler material 212 such as concrete. A cavity in the front portion of the projectile is filled with a high explosive 213. An RF Receiver/Collector unit 214 is located in the projectile. A sensor or impact closing switch 215 is located on board the projectile. The RF Receiver/Collector unit 214 contains a silicon chip which in turn contains a charge collection and storage device, an acceleration sensor, arming switches, counters and a detonator. The sensor or impact closing switch sends a signal or completes a circuit upon impact. In the event that the projectile does not impact an object within a prescribed time, the RF Receiver/Collector unit 214 detonates the main explosive charge 213 to prevent undetonated explosive from being left in the rock mass.

Figure 16:
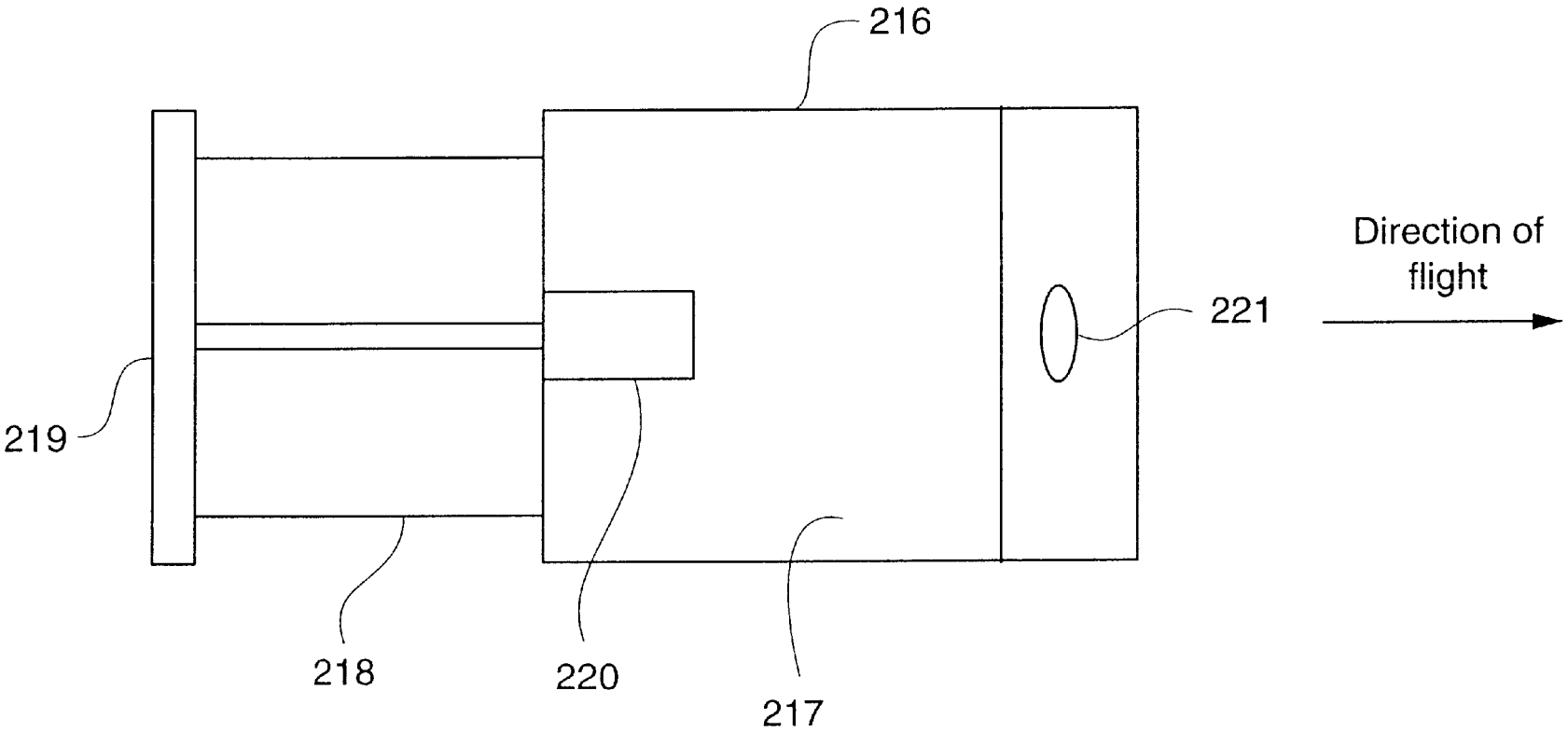
FIG. 16 is a cross-sectional view of a projectile according to a third projectile configuration.

Another projectile configuration is shown in FIG. 16. The projectile is comprised of a container 216 for the explosive 217, a lightweight body 218 formed by, for example plastic fins, and a pusher plate 219 of sufficient thickness to withstand launch pressures typically on the order of 100 to 200 psi (0.70 to 1.4 MPA). In this design, the entire front-end container 216 is filled with explosive 217. As in the heavy projectile shown in FIG. 16, an RF Receiver/Collector unit 220 is located in the body of the explosive 217. A sensor or impact closing switch 221 is located in the front portion of the projectile. The RF Receiver/Collector unit 220 contains a silicon chip which in turn contains a charge collection and storage device, an acceleration sensor, arming switches, counters and a detonator. The sensor or impact closing switch sends a signal or completes a circuit upon impact that causes the detonator to detonate the main explosive charge 217. In the event that the projectile does not impact an object within a prescribed time, the RF Receiver/Collector unit 220 detonates the main explosive charge 217 to prevent undetonated explosive from being left in the rock mass.

The functional components of the Receiver/Collector 222 that fires the propelling charge are shown in FIG. 17. The Receiver/Collector 222 contains a receiving antenna 223 that is attached to a collector 224 which collects electromagnetic energy that is properly encrypted and stores the energy in a storage device 225 (such as a capacitor). When the proper amount of electrical charge is accumulated in the storage device 225, the switch 226 is closed dumping the stored electrical energy across the initiating device 227 for the propelling charge which, in turn, launches the projectile.

The functional components of the Receiver/Collector 228 that controls the arming and fail-safe operation of the fuze in the explosive charge are shown in FIGS. 18A and 18B for two cases. In FIG. 18A, a sensor 229 is used to both detect the onset of acceleration in the launch tube and the impact of the projectile against the target rock mass. The Receiver/Collector unit 228 contains a receiving antenna 230 that is attached to a collector 231 which collects electromagnetic energy that is properly encrypted and stores the energy in a storage device 232 (such as a capacitor). When the proper amount of electrical charge is accumulated in the storage device 232, the switch 233 is closed thereby pre-arming the fuze circuit. Meanwhile, the propelling charge has been initiated and the projectile begins to accelerate. The sensor 229 begins a counter 234 which closes switch 235 after a time that allows the projectile to exit the launch tube. Counter 236 begins either at the start of launch or at the end of the counter 234. When the projectile impacts the target rock mass, the sensor 229 closes switch 237, dumping electrical energy stored in storage device 232 across the detonator which in turn initiates the main explosive charge in the projectile. In the event that the projectile has not impacted the rock mass or has otherwise failed to detonate in a safe period of time, counter 236 times out and closes switch 237 dumping electrical energy stored in storage device 232 across the detonator which in turn initiates the main explosive charge in the projectile. In FIG. 18B, a small sensor 238 in the Receiver/Collector unit 239 detects the launch of the projectile. The Receiver/Collector unit 239 contains a receiving antenna 240 that is attached to a collector 241 which collects electromagnetic energy that is properly encrypted and stores the energy in a storage device 242 (such as a capacitor). When the proper amount of electrical charge is accumulated in the storage device 242, the switch 243 is closed thereby pre-arming the fuze circuit. Meanwhile, the propelling charge has been initiated and the projectile begins to accelerate. The sensor 238 begins a counter 244 which closes switch 245 after a time that allows the projectile to exit the launch tube. Counter 246 begins at either the start of launch or at the end of the counter 244.

When the projectile impacts the target rock mass, the impact switch closes dumping electrical energy stored in storage device 242 across the detonator which in turn initiates the main explosive charge in the projectile. In the event that the projectile has not impacted the rock mass or has otherwise failed to detonate in a safe period of time, counter 246 times out and closes switch 247 dumping electrical energy stored in storage device 242 across the detonator bypassing the impact switch. This initiates the main explosive charge in the projectile.

The functional components of a typical fuze assembly are shown in FIGS. 19A and 19B for two cases. In FIG. 19A, a sensor 248 is used to detect the impact of the projectile against the target rock mass. An RF Receiver/Collector unit 249 contains an RF receiver element, an encryption decoder which allows the properly encrypted RF energy to be collected in an electrical storage device, a switch that is closed to pre-arm the fuze prior to launch, a counter to determine when the final arming switch is closed after the projectile leaves the launch tube, and a counter that determines when to detonate the explosive in the event that the projectile has not impacted the rock mass or has otherwise failed to detonate in a safe period of time. The sensor 248 is connected to the Receiver/Collector 249 and controls switches within the Receiver/Collector unit 249. The Receiver/Collector unit 249 in turn controls the detonator 250. An impact switch 252 is used to detect the impact of the projectile against the target rock mass. The RF Receiver/Collector unit 251 contains an RF receiver element, an encryption decoder which allows the properly encrypted RF energy to be collected in an electrical storage device, a switch that is closed to pre-arm the fuze prior to launch, a counter to determine when the final arming switch is closed after the projectile leaves the launch tube, and a counter that determines when to detonate the explosive in the event that the projectile has not impacted the rock mass or has otherwise failed to detonate in a safe period of time. The impact switch 252 connects the Receiver/Collector 251 with the detonator 253. If the impact switch fails to operate or there is no impact after the fail-safe counter expires, the Receiver/Collector 251 closes an internal switch which dumps the stored electrical energy across the detonator via the by-pass 254.

Figure 20A:
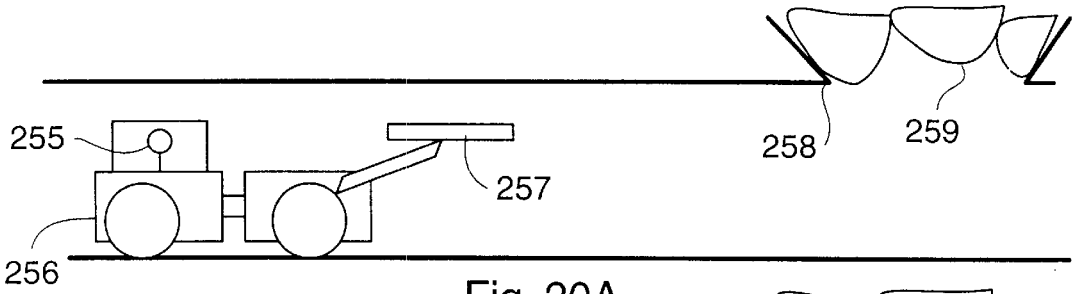
FIGS. 20A–E are schematic sequences of the setup and firing of the launcher by remote control.
Figure 20B:
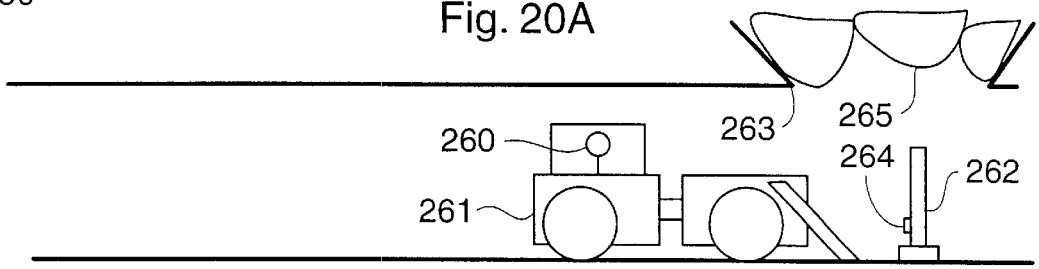
Figure 20C:
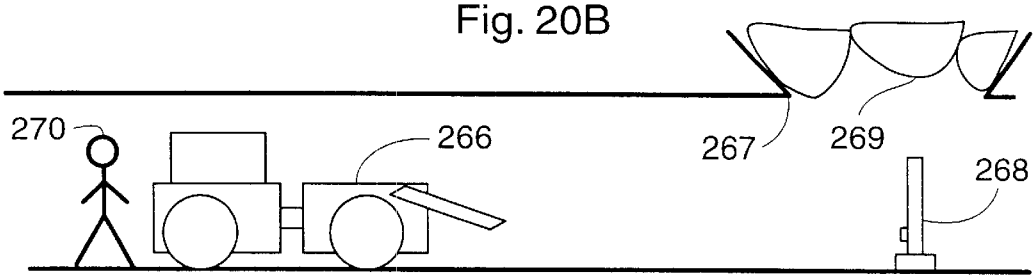
Figure 20D:
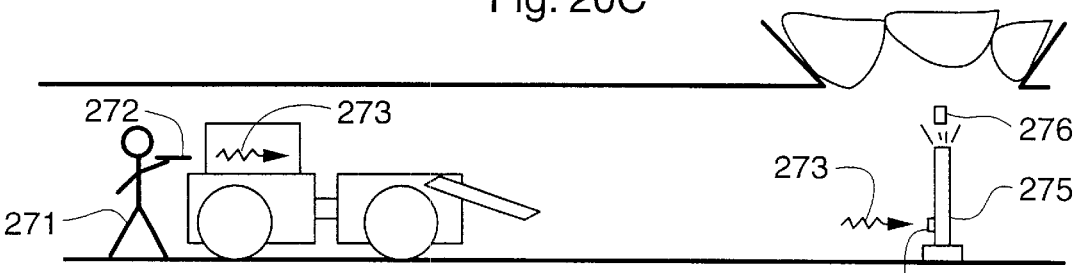
Figure 20E:
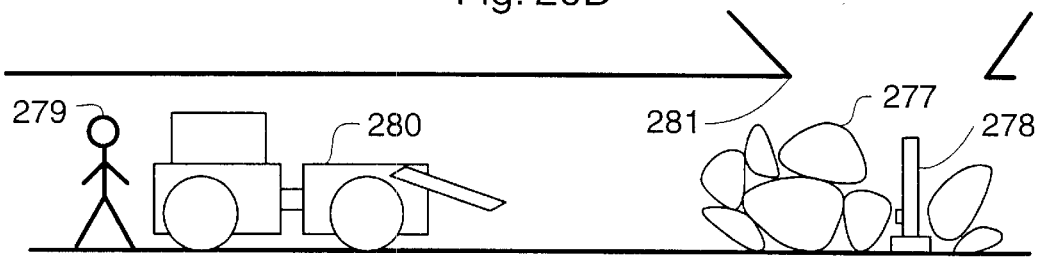

FIGS. 20A–E show a sequence of frames depicting operator operations leading up to launching of the projectile at the rock mass. In FIG. 20A, the operator 255 drives the carrier 256 with the launch tube 257 attached in tramming position towards a drawpoint 258 blocked with a rock mass 259. In FIG. 20B the operator 260 stops the carrier 261 and positions the launch tube 262 under the drawpoint 263. An RF Receiver/Transmitter 264 is shown attached to the launch tube 262. The operator 260 has not left the carrier 261 and is protected from any rock falling from the rock mass 265. In FIG. 20C, the carrier 266 has been moved away from the drawpoint 267, the launch tube 268 is in place for launching towards the rock mass 269, and the operator 270 has assumed a safe launching position. In FIG. 20D, the operator 271 has activated his hand-held RF Controller/Transmitter 272 and has sent an encrypted signal 273 to the Receiver/Transmitter 274 on the launch tube 275. The signal 273 results in the launcher being activated 276. FIG. 20E shows the rock mass 277 having been brought down around the launch tube 278 which can later be safely retrieved from the rock pile. The operator 279 and the carrier 280 have remained safely out of the way of the rock brought down from the drawpoint 281.

Figure 21A:
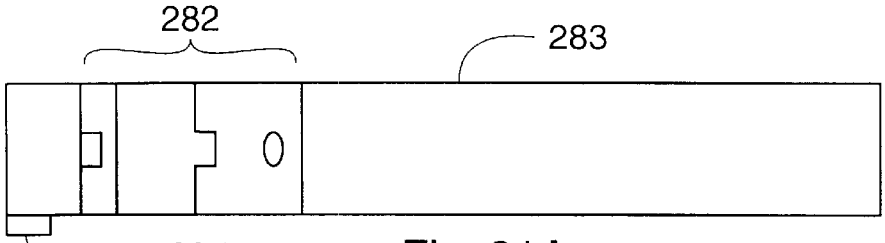
FIGS. 21A–F are schematic sequences of the major projectile/launch tube events following the issuance of the firing command by the operator.
Figure 21B:
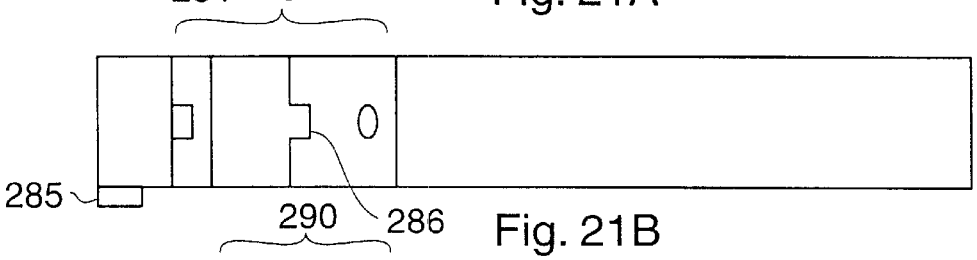
Figure 21C:
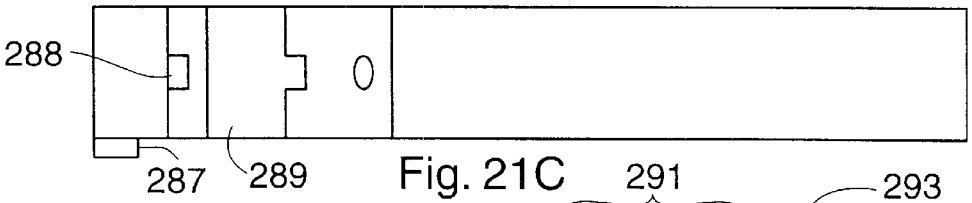
Figure 21D:
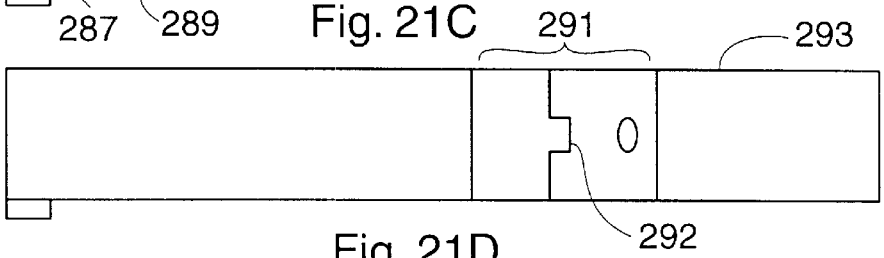
Figure 21E:
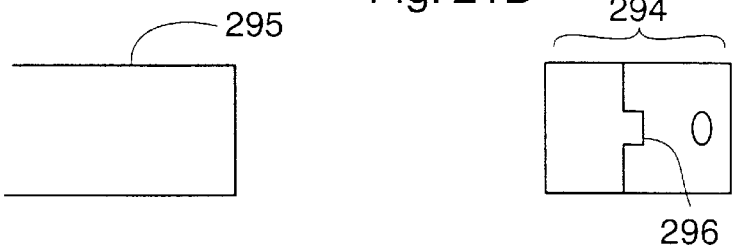
Figure 21F:
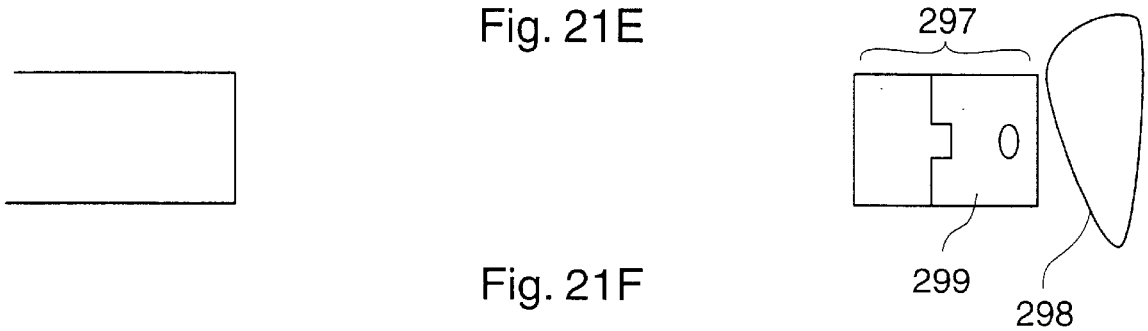

FIGS. 21A–F show a sequence of frames depicting the events occurring as a result of the operator issuing the firing command. FIG. 21A shows the projectile package 282 in firing position within the launch tube 283. The RF Receiver/Transmitter unit 284 is mounted on the launch tube 283. As shown in FIG. 21B, when the RF Receiver/Transmitter 285 receives a properly encrypted signal from the operator's hand-held Controller/Transmitter, it sends an encrypted signal to the Receiver/Collector unit 286 located in the projectile package 287. This signal activates the Receiver/Controller 286 to close the pre-arm switch on the fuze and to collect RF energy and stores it in the on-board storage device. Next, as shown in FIG. 21C, the RF Receiver/Transmitter 287 sends an encrypted signal to the other Receiver/Collector unit 288 located in the propelling charge 289. The Receiver/Collector unit 288 then collects RF energy and stores it in the on-board storage device. When this electrical storage device is fully charged, the propelling charge 289 is automatically initiated beginning the acceleration of the projectile 290. The acceleration of the projectile 291 shown in FIG. 21D begins a counter that determines when the projectile 291 has exited the launch tube 293. In FIG. 21E, the projectile 294 has exited the launch tube 295 and is in free flight. When the counter in the on-board Receiver/Collector 296 determines that a predetermined time interval has elapsed, the counter generates a control signal to close the final arming switch to fully arm the fuze in the explosive charge. A second counter in Receiver/Collector unit 296 has begun counting at the same time as the fuze arming counter or alternately begins counting when the fuze arming counter ends and fully arms the fuze. In FIG. 21F, the projectile 297 impacts the target rock mass 298 and the fuze detonates the explosive charge 299. In the case where the projectile 297 does not detonate on impact or does not impact the target rock mass, when the second counter determines that a predetermined time interval has elapsed, the counter generates a control signal to detonate the explosive charge 299.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the appended claims.

What is claimed is:

1. A projectile for removing a body of rock in an excavation, comprising:

a nose at the front of the projectile;

a body located behind the nose and containing a detonating device and an explosive charge, the detonating device including a detonator to detonate the explosive charge and being located in a pocket having at least one of a length and width that exceeds a corresponding one of the length and width of the detonating device, thereby permitting at least one of longitudinal and latitudinal motion of the detonating device in the pocket in response to movement of the projectile; and a tail located behind the body and having a plurality of transversely oriented fins to stabilize the trajectory of the projectile.

2. The projectile of claim 1, wherein the nose is at least one of substantially flat and concave to inhibit deflection of the projectile from a face of the rock.

3. The projectile of claim 1, wherein the outer diameter of the body is no less than about 25% and no more than about 100% of the outer diameter of the tail.

4. The projectile of claim 1, wherein the body has an outer wall composed of plastic.

5. The projectile of claim 1, wherein the tail has a length and the length is at least about 60% of the total length of the projectile.

6. The projectile of claim 4, wherein the thickness of the outer wall ranges from about 1 to about 6 mm.

7. The projectile of claim 1, wherein the body includes a plurality of ribs located beneath and supporting the explosive charge and wherein the number of ribs is at least 6.

8. The projectile of claim 1, wherein the center of gravity of the projectile is located in the body and the center of pressure of the projectile is located in the tail.

9. The projectile of claim 1, further comprising at least one receiver unit for receiving a control signal from a transmitter and for pre-arming, arming, or detonating the detonating device.

10. The projectile of claim 1, further comprising a counter to determine a time interval after the firing of the projectile from a firing tube and provide a control signal to fully arm the detonating device.

11. The projectile of claim 1, further comprising a counter to determine a time interval after the firing of the projectile from a firing tube and provide a control signal to detonate the detonating device.

12. The projectile of claim 1, wherein the width of the detonating device is less than the width of the pocket.

13. The projectile of claim 1, wherein the gap between a sidewall of the detonating device and a sidewall of the pocket ranges from about 0.5 to about 4.0 mm.

14. The projectile of claim 1, wherein a gap exists between an inner wall of the pocket and an outer wall of the detonating device and the gap ranges from about 0.5 to about 4.0 mm.

15. The projectile of claim 1, wherein the detonating device has a primer and the detonator in a proximal end and a striker in a distal end, the striker and primer being separated from one another by a spring member which forces the striker away from the primer and a safety pin which restricts the motion of the striker towards the primer.

16. The projectile of claim 1, wherein a distal end of the detonating device has a larger outer diameter than a proximal end of the detonating device such that the proximal end of the detonating device can be received along substantially the entire length of the pocket and the distal end of the detonating device cannot be received along substantially the entire length of the pocket.

17. The projectile of claim 1, wherein the detonating device has a width that is at least about 65% and no more than about 95% of the width of the pocket volume.

18. The projectile of claim 1, wherein the length of the detonating device ranges from about 75 to about 100% of the length of the pocket.

19. A method for removing a body of rock in an excavation, comprising:

aiming a launch tube containing a projectile such that the projectile impacts a target area on the body of rock after launching;

launching the projectile from the tube; and contacting the nose of the projectile with the target area, wherein in the contacting step a detonating device in the projectile is located in a pocket in the projectile, the pocket having at least one of a length and width that exceeds a corresponding one of the length and width of the detonating device, thereby permitting at least one of longitudinal and latitudinal motion of the detonating device in the pocket in response to movement of the projectile.

20. The method of claim 19, wherein the projectile has a nose that is at least one of substantially flat and concave to inhibit deflection of the projectile from a face of the rock.

21. The method of claim 19, wherein the outer diameter of the projectile body is no less than about 25% and no more than about 100% of the outer diameter of the tail.

22. The method of claim 19, wherein the projectile has a tail that has a length and the length is at least about 60% of the total length of the projectile.

23. The method of claim 22, wherein the thickness of an outer wall of the projectile body ranges from about 1 to about 6 mm.

24. The method of claim 19, wherein the projectile body includes a plurality of ribs located beneath and supporting an explosive charge and wherein the number of ribs is at least 6.

25. The method of claim 19, wherein a center of gravity of the projectile is located in the projectile body and the center of pressure of the projectile is located in the tail.

26. The method of claim 19, wherein a gap between a sidewall of the detonating device and a sidewall of the pocket ranges from about 0.5 to about 4.0 mm.

27. The method of claim 19, wherein a gap exists between an inner wall of the pocket and an outer wall of the detonating device and the gap ranges from about 0.5 to about 4.0 mm.

28. The method of claim 19, wherein the detonating device has a primer and a detonator in a proximal end of the detonating device and a striker in a distal end of the detonating device, the striker and primer being separated from one another by a spring member which forces the striker away from the primer and a safety pin which restricts the motion of the striker towards the primer.

29. The method of claim 19, wherein a distal end of the detonating device has a larger outer diameter than a proximal end of the detonating device such that the proximal end of the detonating device can be received along substantially the entire length of the pocket and the distal end of the detonating device cannot be received along substantially the entire length of the pocket.

30. The method of claim 19, further comprising:

transmitting a control signal to a receiver from a remote location to cause at least one of the following to occur: launching of the projectile from the launch tube and arming of the projectile.

31. The method of claim 30, further comprising:

when the projectile is launched, transmitting a second control signal to a counter in the projectile;

when the counter determines that a predetermined time interval is reached, generating a third control signal to perform at least one of the following steps:

arming the detonating device; and initiating the detonating device to ignite an explosive charge in the projectile.

32. The method of claim 19, further comprising;

moving a striker in the detonating device in the projectile forwardly against a resistance of a spring member; and impacting a primer with the front portion of the striker to initiate the primer, thereby initiating a detonator and thereby initiating an explosive charge contained in the projectile.

33. The method of claim 30, further comprising;

converting the control signal into electrical energy and when a predetermined amount of electrical energy is generated, transmitting the electrical energy to a firing device to initiate the launching step.

34. The method of claim 30, further comprising;

converting the control signal to electrical energy and when a predetermined amount of electrical energy is generated, transmitting the electrical energy to activate a device to pre-arm or arm the detonating device.

35. The method of claim 19, wherein a velocity of the projectile during flight ranges from about 25 m/sec to about 250 m/sec.

* * * * *